US005834663A

United States Patent [19]

Fukuno et al.

[11] Patent Number: 5,834,663

[45] Date of Patent: Nov. 10, 1998

[54] SINTERED MAGNET AND METHOD FOR MAKING

[75] Inventors: Akira Fukuno; Hideki Nakamura; Gouichi Nishizawa, all of Chiba, Japan

[73] Assignee: TDK Corporation, Tokyo, Japan

[21] Appl. No.: 824,008

[22] Filed: Mar. 25, 1997

Related U.S. Application Data

[62] Division of Ser. No. 364,756, Dec. 27, 1994, Pat. No. 5,641,363.

[30] Foreign Application Priority Data

| | | | |
|---|---|---|---|
| Dec. 27, 1993 | [JP] | Japan | 5-353916 |
| Dec. 27, 1993 | [JP] | Japan | 5-353917 |
| Dec. 29, 1993 | [JP] | Japan | 5-353675 |
| Mar. 31, 1994 | [JP] | Japan | 6-87861 |

[51] Int. Cl.[6] ..... C22C 29/14

[52] U.S. Cl. ..... 75/244; 148/302; 148/104; 419/12

[58] Field of Search ..... 148/302, 104; 420/83, 121; 75/244; 419/12

[56] References Cited

U.S. PATENT DOCUMENTS

| | | | |
|---|---|---|---|
| 4,921,531 | 5/1990 | Nagle et al. | 75/351 |
| 4,952,252 | 8/1990 | Ghandehari | 148/302 |
| 5,057,148 | 10/1991 | Micheli et al. | 75/351 |
| 5,536,334 | 7/1996 | Kabayashi et al. | 148/101 |

OTHER PUBLICATIONS

Akira Fukuno, et al, "Near–Shaped ND–FE–B Sintered Magnet", Abstracts of the Japan Institute of Metals, 1 page, Oct. 8, 1994 (with English translation).

*Primary Examiner*—John Sheehan

*Attorney, Agent, or Firm*—Oblon, Spivak, McClelland, Maier & Neustadt, P.C.

[57] ABSTRACT

In the manufacture of a rare earth sintered magnet of the $Nd_2Fe_{14}B$ system, closed voids are formed in the magnet in a predetermined fraction to minimize shrinkage. Unlike open voids or pores in conventional semi-sintered magnets, the closed voids do not incur magnet corrosion since they do not communicate to the magnet exterior. By minimizing shrinkage during sintering in this way, a ring or plate-shaped thin wall anisotropic magnet can be prepared without machining for shape correction, achieving a cost reduction and a productivity improvement. Since a high density compact has a high deflective strength, it is easy to handle, minimizing cracking and chipping between the compacting and sintering steps.

18 Claims, 2 Drawing Sheets

1000 μm

100 μm

SINTERED MAGNET AND METHOD FOR MAKING

This is a Division of application Ser. No. 08/364,756 filed on Dec. 27, 1994, now U.S. Pat. No. 5,641,363.

BACKGROUND OF THE INVENTION

1. Field of the Invention

This invention relates to a rare earth sintered magnet having experienced minimal shrinkage during sintering and a method for preparing the same.

2. Prior Art

As rare earth magnets of high performance, powder metallurgical Sm—Co system magnets having an energy product of 32 MGOe have been produced on a large commercial scale. Also R—T—B system magnets (wherein T stands for Fe or Fe plus Co) such as Nd—Fe—B magnets were recently developed. For example, a sintered magnet is disclosed in Japanese Patent Application Kokai (JP-A) No. 46008/1984. The R—T—B system magnets use inexpensive raw materials as compared with the Sm—Co system magnets. For the manufacture of R—T—B system sintered magnets, a conventional powder metallurgical process for Sm—Co systems (melting→casting→ingot crushing→fine pulverization→compacting→sintering→magnet) is applicable.

Among the R—T—B system magnets, bonded magnets having a magnet powder bound with a resin binder or metal binder have also been used in practice as well as the sintered magnets. Since the bonded magnets maintain their dimensions upon molding substantially unchanged, their dimensional precision is high enough to eliminate shaping after their manufacture. However, the commercially available R—T—B system bonded magnets are difficult to impart anisotropy by molding in a magnetic field because they use polycrystalline particles containing crystallites prepared by a quenching technique such as a single chill roll technique. Ground powders of R—T—B system sintered magnets cannot be used as a source powder for bonded magnets because they suffer from a drastic decline of coercivity due to strains and oxidation by grinding. It was also proposed to react a ground powder of an R—T—B system alloy ingot with hydrogen to decompose it into a rare earth element hydride, a T boride, and T and to effect dehydration at a predetermined temperature to precipitate crystallites having aligned crystallographic orientation in discrete particles. Although polycrystalline particles obtained by this process can be oriented in a magnetic field and high coercivity is achieved due to crystallites, the process is complex because of the use of hydrogen and has not been used in practice.

In contrast, in the case of R—T—B system sintered magnets, anisotropic magnets are readily obtained because a powder consisting essentially of single crystal particles is compacted in a magnetic field, and higher properties are available because no binder is used. In the sintering process, however, compacts drastically shrink during sintering reaction. It is difficult to maintain the dimensional precision of compacts because shrinkage occurs randomly. The shrinkage varies with a varying degree of orientation of particles in compacts and a varying density. Anisotropic sintered magnets have different shrinkage factors in the direction of easy axis of magnetization and a direction perpendicular thereto. For a compact having a density of 4.3 g/cm$^3$, for example, the shrinkage factor is about 22% in the direction of easy axis of magnetization and about 15% in the perpendicular direction and the density reaches 7.55 g/cm$^3$ after sintering.

Such dimensional changes in anisotropic sintered magnets are serious particularly with thin walled, ring or plate-shaped magnets. This is because deflection occurs if a thin walled magnet have uneven shrinkage factors. Then sintered bodies are machined for correcting such dimensional changes before they are marketed. However, the machining process has the problems described below.

(1) Machining of sintered bodies entails a great loss of material. For example, if a deflection of 1 mm occurs in the manufacture of a thin plate-shaped magnet of 1 mm thick, a sintered body of about 3 mm thick must be first produced and then machined at its upper and lower surfaces, resulting in a loss of ⅔ of the material. Such a loss might be avoided by an approach of cutting a plurality of thin plate-shaped magnets out of a single thick block to a thickness of 1 mm, but a loss of about 40% occurs if the machining cutter has a cutting edge width of 0.6 mm. Due to their low mechanical strength, thin wall sintered bodies are liable to chip or crack by impacts during machining or during handling, resulting in a low manufacturing yield.

(2) Magnetic properties become poor. It is precisely reported in the literature that the coercivity of $Nd_2Fe_{14}B$ system sintered magnets depends on the presence of a Nd-rich phase in the grain boundary. In machining sintered magnets of this system, stresses cause cracks to occur along grain boundaries in a region near the machined surface, and coercivity is lost in a region extending from the machined surface to a depth of 0.1 to 0.2 mm. A loss of magnet properties in proximity to the surface being machined is negligible in the case of thick wall magnets, but detrimental in the case of thin wall magnets so that the magnets as a whole show an apparent loss of magnetic properties. It is possible to remove by acid etching the region where coercivity is lost by machining although a material loss of the sintered body is further increased to raise the manufacturing cost.

Under the circumstances, Sm—Co system bonded magnets are generally used for thin wall anisotropic magnets having a longitudinal length/thickness ratio of at least 10, leaving the problem of an increased cost. Thin wall sintered magnets of the R—T—B system are available, but essentially require machining for dimensional adjustment wherein the material yield during machining is 20 to 30%, also raising the problem of an increased cost.

DISCLOSURE OF THE INVENTION

An object of the present invention is, in the manufacture of an R—T—B system sintered magnet, to minimize a dimensional change during sintering to eliminate a need for machining after sintering to thereby provide an inexpensive thin wall magnet. Another object of the present invention is to provide such a thin wall magnet having high coercivity and high remanence.

These and other objects are achieved by the present invention which is defined below as (1) to (33).

(1) A sintered magnet comprising R, T and B wherein R is at least one element of rare earth elements inclusive of yttrium and T is iron or iron and cobalt, and containing 2 to 15% by volume of closed voids.

(2) The sintered magnet of (1) which contains 3 to 15% by volume of closed voids.

(3) The sintered magnet of (1) which has a density of up to 7.2 g/cm$^3$.

(4) The sintered magnet of (1) wherein the closed voids each have an average projection cross-sectional area of 1,000 to 30,000 $\mu m^2$.

(5) The sintered magnet of (1) wherein the fraction of open voids is up to 2% by volume.

(6) The sintered magnet of (1) which consists essentially of 30 to 45% by weight of R, 0.5 to 3.5% by weight of B and the balance of T.

(7) The sintered magnet of (1) which has not been shaped after sintering and which has a parallel portion, wherein the maximum length divided by the average thickness of said parallel portion is at least 10, and a thickness deviation is up to 1.5%, the thickness deviation being the difference between the maximum and the minimum of thickness of said parallel portion divided by the maximum length of said parallel portion.

(8) The sintered magnet of (1) which has not been shaped after sintering and which has a cylindrical portion, wherein the average outer diameter divided by the average wall thickness of said cylindrical portion is at least 10, and an outer diameter deviation is up to 1.5%, the outer diameter deviation being the difference between the maximum and the minimum of outer diameter of said cylindrical portion divided by the average outer diameter of said cylindrical portion.

(9) The sintered magnet of (1) which has not been shaped after sintering and which has a cylindrical portion, wherein the average outer diameter divided by the average wall thickness of said cylindrical portion is at least 10, and an inner diameter deviation is up to 1.5%, the inner diameter deviation being the difference between the maximum and the minimum of inner diameter of said cylindrical portion divided by the average inner diameter of said cylindrical portion.

(10) The sintered magnet of (1) which contains 0.5 to 10% by weight of an R oxide.

(11) A method for preparing a sintered magnet comprising R, T and B wherein R is at least one element of rare earth elements inclusive of yttrium and T is iron or iron and cobalt, comprising the steps of compacting a mixture of a powder of a primary phase-forming master alloy and a powder of a grain boundary phase-forming master alloy and sintering the compact to form a sintered magnet containing 2 to 15% by volume of closed voids, wherein said primary phase-forming master alloy contains crystal grains consisting essentially of $R_2T_{14}B$ and has a mean particle size of at least 20 $\mu$m, said boundary phase-forming master alloy consists essentially of 70 to 97% by weight of R and the balance of iron and/or cobalt, is left on a screen having an opening of at least 38 $\mu$m, but passes a screen having an opening of up to 500 $\mu$m.

(12) A method for preparing a sintered magnet comprising R, T and B wherein R is at least one element of rare earth elements inclusive of yttrium and T is iron or iron and cobalt and containing 2 to 15% by volume of closed voids, said method comprising the step of sintering a compact composed of a magnet powder with a mean particle size of 70 to 350 $\mu$m and having a density of at least 5.5 g/cm$^3$ so as to induce a density change of at least 0.2 g/cm$^3$.

(13) A method for preparing a sintered magnet comprising R, T and B wherein R is at least one element of rare earth elements inclusive of yttrium and T is iron or iron and cobalt and containing 2 to 15% by volume of closed voids, said method comprising the steps of compacting a mixture of a magnet powder having crystal grains consisting essentially of $R_2T_{14}B$ and an R oxide powder to form a compact having a density of at least 5.5 g/cm$^3$ and sintering the compact so as to induce a density change of at least 0.2 g/cm$^3$.

(14) The method for preparing a sintering magnet of (13) wherein said magnet powder has a mean particle size of 30 to 350 $\mu$m.

(15) A method for preparing a sintered magnet comprising R, T and B wherein R is at least one element of rare earth elements inclusive of yttrium and T is iron or iron and cobalt and containing 2 to 15% by volume of closed voids, said method comprising the steps of compacting a mixture of a powder of a primary phase-forming master alloy having crystal grains consisting essentially of $R_2T_{14}B$, a powder of a grain boundary phase-forming master alloy consisting essentially of 70 to 97% by weight of R and the balance of iron and/or cobalt, and a powder of an R oxide to form a compact and sintering the compact.

(16) The method for preparing a sintering magnet of (15) wherein said primary phase-forming master alloy powder has a mean particle size of 30 to 350 $\mu$m.

(17) The method for preparing a sintering magnet of (15) wherein said boundary phase-forming master alloy is left on a screen having an opening of at least 38 $\mu$m, but passes a screen having an opening of up to 500 ρm.

(18) The method for preparing a sintering magnet of (13) or (15) wherein the R oxide powder is present in said mixture in a proportion of 0.5 to 10% by weight and has a mean particle size of 0.5 to 20 $\mu$m.

(19) A method for preparing a sintered magnet comprising R, T and B wherein R is at least one element of rare earth elements inclusive of yttrium and T is iron or iron and cobalt and containing 2 to 15% by volume of closed voids, said method comprising the steps of heat treating a mixture of a powder of a primary phase-forming master alloy having a phase consisting essentially of $R_2T_{14}B$ and a powder of a grain boundary phase-forming master alloy consisting essentially of 70 to 97% by weight of R and the balance of iron and/or cobalt, such that the grain boundary phase-forming master alloy may melt, then disintegrating, compacting, and sintering.

(20) The method for preparing a sintered magnet of (19) wherein the grain boundary phase-forming master alloy is present in said mixture in a proportion of 2 to 15% by weight.

(21) The method for preparing a sintered magnet of (19) wherein the primary phase-forming master alloy powder is magnetized prior to the heat treatment.

(22) The method for preparing a sintered magnet of (19) wherein crystal grains of the primary phase-forming master alloy have an average ratio of major axis/minor axis of up to 3 and powder particles of the primary phase-forming master alloy have an average ratio of major axis/minor axis of up to 3.

(23) The method for preparing a sintered magnet of (19) wherein the powder of the primary phase-forming master alloy has a mean particle size of at least 20 $\mu$m.

(24) The method for preparing a sintered magnet of (19) wherein a sintered magnet consisting essentially of 27 to 40% by weight of R, 0.5 to 4.5% by weight of B and the balance of T is prepared.

(25) The method for preparing a sintered magnet of (11) or (15) wherein the grain boundary phase-forming master alloy powder is present in said mixture in a proportion of 2 to 20% by weight.

(26) The method for preparing a sintered magnet of (11), (15) or (19) wherein neodymium occupies at least 50% of the R of said grain boundary phase-forming master alloy.

(27) The method for preparing a sintered magnet of (11), (15) or (19) wherein said grain boundary phase-forming master alloy is prepared by a melt quenching technique.

(28) The method for preparing a sintered magnet of (11), (15) or (19) wherein the sintering step is effected at a temperature equal to or higher than the melting point of said grain boundary phase-forming master alloy.

(29) The method for preparing a sintered magnet of (11), (12), (13), (15) or (19) wherein the sintering temperature is 900° to 1,100° C.

(30) The method for preparing a sintered magnet of (11), (12), (13), (15) or (19) wherein the sintering step is effected in vacuum.

(31) The method for preparing a sintered magnet of (11), (15) or (19) which includes the step of sintering a compact having a density of at least 5.5 g/cm$^3$ so as to induce a density change of at least 0.2 g/cm$^3$.

(32) The method for preparing a sintered magnet of (11), (12), (13), (15) or (19) wherein a compact having a deflective strength of at least 0.3 kgf/mm$^2$ is sintered.

(33) The method for preparing a sintered magnet of (11), (12), (13), (15) or (19) wherein a compacting pressure is at least 6 t/cm$^2$.

FUNCTION AND ADVANTAGES

Conventional compacts for $Nd_2Fe_{14}B$ sintered magnets have a density (of about 4.2 g/cm$^3$) corresponding to about 55% of the density assumed to be void free (theoretical density: about 7.6 g/cm$^3$) and contain about 45% of voids. By sintering, they are consolidated to about 99% of the theoretical density with a concomitant increase of volume shrinkage factor.

In contrast, the present invention minimizes shrinkage by forming a predetermined fraction of closed voids in a magnet during sintering. Unlike open voids or pores in conventional semi-sintered magnets to be described later, the closed voids do not incur magnet corrosion since they are not in communication with the magnet exterior. By minimizing the shrinkage factor during sintering in this way, a need for machining for shape correction is eliminated even when ring- or plate-shaped thin anisotropic magnets are manufactured, achieving a cost reduction and a productivity improvement. Since a high density compact has a high deflective strength, it is easy to handle and the likelihood of cracking and chipping between the compacting and sintering steps is minimized.

The sintered magnets of the present invention have magnetic properties, specifically (BH)max=about 17 to 25 MGOe, which are lower than conventional R—T—B system high density sintered magnets, but higher than Sm—Co system bonded magnets having (BH)max=about 15 MGOe. R—T—B system magnets use less expensive raw materials than Sm—Co system magnets. Therefore, the sintered magnets of the invention are suited as a substitute for Sm—Co system bonded magnets which have been used as thin wall magnets.

In the practice of the invention, any of the four methods described below is preferably employed in order to form the above-defined closed voids.

First method

The first method uses a two alloy route. The two alloy route for the manufacture of R—T—B system sintered magnets is by mixing two alloys of different compositions in powder form followed by sintering. The first method uses the aforementioned primary phase-forming master alloy and grain boundary phase-forming master alloy in the two alloy route. The powder of primary phase-forming master alloy used in the first method has a similar composition to those used in the conventional two alloy route, but a greater particle size. The first method further uses the grain boundary phase-forming master alloy powder in the form of an R-rich powder having a large diameter never used in the prior art so that closed voids may be formed upon firing. This grain boundary phase-forming master alloy powder has a low melting point composition centering at $Nd_{89}Fe_{11}$ (weight ratio). The grain boundary phase-forming master alloy powder melts during sintering to form a liquid phase fully wettable to the $R_2T_{14}B$ primary phase and flow as such to enclose particles of the primary phase-forming master alloy, eventually becoming the grain boundary phase of the magnet to improve its coercivity. The powder of grain boundary phase-forming master alloy has a large diameter and is likely to melt and flow. Then after the grain boundary phase-forming master alloy powder has melted and flowed, there are left large closed voids which cannot be refilled by sintering reaction.

Although the conventional two alloy route adds an R-rich powder which eventually becomes a grain boundary phase at the end of sintering, no closed voids are left in the sintered body because the conventionally used R-rich powder is of small diameter. The purposes of adding an R-rich powder in the conventional two alloy route are to improve coercivity and to promote liquid phase sintering to increase the density of a magnet. In conjunction with the two alloy route including the addition of R-rich powder, an attempt to reduce a shrinkage factor at the sacrifice of a sintered density has never been made in the art.

Open voids are also present in proximity to the surface of the sintered magnet prepared by the first method. If at least a portion of the sintering step is carried out in vacuum or in a reduced pressure atmosphere, the liquefied grain boundary phase-forming master alloy blocks paths of open voids communicating to the exterior to thereby reduce the fraction of open voids, achieving an improvement in corrosion resistance.

Preferably, the first method uses a compact having a high density (of at least 5.5 g/cm$^3$) and does not complete sintering (a sintered density of up to 7.2 g/cm$^3$). This ensures a further reduced shrinkage factor during sintering.

It is noted that although various proposals for preparing $R_2T_{14}B$ system sintered magnets by way of the two alloy route have been made as will be described later and methods of preparing a low density, porous sintered body by sintering a compact incompletely are known as will be described later, these methods are different from the first method.

Second method

Since the second method uses a compact having a high density (of at least 5.5 g/cm$^3$) and does not complete sintering (a sintered density of up to 7.2 g/cm$^3$), it ensures a reduced shrinkage factor during sintering.

It is noted that although methods of preparing a low density, porous sintered body by sintering a compact incompletely are known as will be described later, they do not suggest the construction of the second method.

Third method

The third method is to form the aforementioned closed voids by adding a powder of R oxide to a magnet powder (primary phase-forming master alloy powder) and compacting the mixture to a high density followed by sintering. Since the R oxide powder is effective for inhibiting sintering and particles can migrate with difficulty in a high density compact during sintering, closed voids are formed in the magnet at the end of sintering.

One preferred embodiment of the third method uses a two alloy route. The two alloy route for the manufacture of R—T—B system sintered magnets is by mixing two alloys of different compositions in powder form followed by sintering. The third method uses the aforementioned primary phase-forming master alloy and grain boundary phase-forming master alloy in the two alloy route. The powder of primary phase-forming master alloy used in the third method has a similar composition to those used in the conventional two alloy route, but preferably a greater particle size. The grain boundary phase-forming master alloy used in the third method has a low melting composition centering at $Nd_{89}Fe_{11}$ (weight ratio). The grain boundary phase-forming master alloy powder melts during sintering to form a liquid phase fully wettable to the $R_2T_{14}B$ primary phase and flow as such to enclose particles of the primary phase-forming master alloy, eventually becoming the grain boundary phase of the magnet to improve its coercivity. In addition to these alloys, the third method adds a powder of R oxide. The R-rich grain boundary phase-forming master alloy enhances sintering, resulting in an increased shrinkage factor during sintering. However, the third method also adds the R oxide powder which inhibits sintering, suppressing sintering reaction to minimize the shrinkage factor. Moreover, the addition of R oxide reduces remanence, but rather improves coercivity. The R oxide in contact with the R-rich grain boundary phase-forming master alloy is reduced into an active metal pursuant to chemical equilibrium. Since the metal in active state is more likely to react with the $R_2T_{14}B$ primary phase than the grain boundary phase-forming master alloy added, coercivity is improved. Furthermore, the grain boundary phase-forming master alloy powder melts to enclose the R oxide to prevent the R oxide from direct contact with the primary phase.

Further, since the third method adds the R oxide powder to inhibit sintering reaction, vacancies where the grain boundary phase-forming master alloy particles have melted and flowed are not readily refilled by the sintering reaction, facilitating formation of closed voids. Large closed voids are readily formed particularly when the compact has a high density enough to restrain migration of particles or when the particles of grain boundary phase-forming master alloy have a large diameter.

The conventional two alloy route adds an R-rich powder which eventually becomes a grain boundary phase at the end of sintering, but not an R oxide powder. The purposes of adding an R-rich powder in the conventional two alloy route are to improve coercivity and to promote liquid phase sintering to increase the density of a magnet. In conjunction with the two alloy route including the addition of R-rich powder, an attempt to reduce a shrinkage factor at the sacrifice of a sintered density has never been made in the art.

Preferably, the third method uses a compact having a high density (of at least 5.5 g/cm$^3$) and does not complete sintering (a sintered density of up to 7.2 g/cm$^3$). This ensures a further reduced shrinkage factor during sintering.

It is known to prepare $R_2T_{14}B$ system sintered magnets by adding an R oxide powder to a magnet powder as will be described later. Various proposals for preparing $R_2T_{14}B$ system sintered magnets by way of the two alloy route have been made and methods of preparing a low density, porous sintered body by sintering a compact incompletely are known as will be described later. However, all these methods are different from the third method.

Fourth method

In a conventional two alloy route as will be described later, it is intended to achieve high coercivity by melting an R-rich powder to enclose $R_2T_{14}B$ system particles during sintering. However, since a mixture of a magnetic $R_2T_{14}B$ powder and a non-magnetic R-rich powder is compacted in a magnetic field, this method allows for localization of the R-rich powder in the compact. Such a compact is sintered into a magnet which is internally uneven in density and coercivity so that a shape deformation is incurred and magnet properties are low. Also application of a magnetic field to a mixture of a magnetic powder and a non-magnetic powder prohibits orientation of magnetic particles and results in a compact having a low density.

Also in the conventional two alloy route, R-rich powder is melted in a compression molded compact, and the flow of the liquefied R-rich alloy is thus restrained, resulting in a magnet having an insufficiently even dispersion of the R-rich phase.

When it is desired to prepare high coercivity $R_2T_{14}B$ system sintered magnets by conventional powder metallurgy other than the two alloy route, a master alloy having a high R content is used. Higher R contents lead to increased shrinkage factors because sintering is promoted. It is to be noted that although Nd is generally used as R of $R_2T_{14}B$ system sintered magnets, replacement of a part of Nd by Dy improves the anisotropic magnetic field of the primary phase, resulting in higher coercivity. However, Dy is more expensive than Nd.

As opposed to these conventional methods, the fourth method carries out heat treatment on a mixture of a powder of primary phase-forming master alloy having a $R_2T_{14}B$ phase and an R-rich grain boundary phase-forming master alloy containing a predetermined amount of R such that the grain boundary phase-forming master alloy may melt. This grain boundary phase-forming master alloy has a low melting temperature composition centering at $Nd_{89}Fe_{11}$ (weight ratio). The heat treatment causes the grain boundary phase-forming master alloy to form a liquid phase fully wettable to the primary phase-forming master alloy powder and flow as such to enclose particles of the primary phase-forming master alloy.

Since the grain boundary phase-forming master alloy is melted prior to compression molding according to the fourth method, the once liquefied grain boundary phase-forming master alloy can flow easily to avoid localization of the R-rich phase in the magnet at the end of sintering. Due to the eliminated localization of the R-rich phase, even those magnets having a low R content as a whole can have high coercivity and hence, high remanence or residual magnetic flux density. Under the same compacting pressure, a compact having a higher density is obtained than when the two alloy route is used. Orientation during compacting in a magnetic field is also improved over the two alloy route.

After cooling, primary phase-forming master alloy particles are bound together by the R-rich phase. Since this binding is very weak, the mass can be readily disintegrated. After disintegration, primary phase-forming master alloy particles at their periphery are substantially uniformly covered with the R-rich phase.

In one preferred embodiment of the fourth method, by using a powder of the primary phase-forming master alloy having a relatively large mean diameter and a compacting pressure greater than in the conventional methods, there is produced a compact which is less prone to sintering and hence, will have a lower shrinkage factor in the sintering step. The compact is sintered into a magnet without driving sintering to completion. More specifically, a compact having a density as high as 5.5 g/cm$^3$ or more is sintered into a magnet having a density of up to 7.2 g/cm$^3$. This results in a minimized shrinkage factor during sintering.

Prior art methods

JP-A 47528/1993 discloses a method for preparing an anisotropic rare earth bonded magnet. According to this method, an Nd—Fe—B magnet powder is first mixed with a sintering inhibitor or gasifying agent or oxidized at the surface before the magnet powder is compressed under a pressure of 0.2 to 5 t/cm$^2$ in a magnetic field to form a compact. The compact is then fired at 500° to 1,140° C. to form an anisotropic fired body having open pores, which is heat treated at 400° to 1,000° C. Then the fired body is impregnated with a resin into open pores, which is cured. Tables 1 and 2 of this patent publication report the density of fired bodies which were prepared by adding various sintering inhibitors and firing at 700° to 1,0600° C. (prior to resin impregnation). All the samples have a density of less than 6.9 g/cm$^3$.

The sintering inhibitors described in said patent publication include oxides, fluorides, and chlorides which do not melt during firing or melt only partially during firing. The patent publication describes that since these sintering inhibitors prevent flow of an R-rich liquid phase generated during firing, a fired body does not substantially shrink even when high-temperature firing is effected, and as a result, the firing temperature can be higher than in the prior art and higher coercivity is obtained. The gasifying agents described in the patent publication are camphor, phosphorus, sulfur and tin and they are gasified during firing to leave open pores. These open pores are continuous pores having an inlet at the surface of a fired body and a size enough to allow the resin to penetrate thereinto.

Although sintered magnets having a low density of up to 6.9 g/cm$^3$ are obtained according to the method of said patent publication, the method intends to form open pores as opposed to the present invention. It is described in the patent publication that firing is terminated before closed pores are formed and that higher the fraction of open pore volume relative to entire pore volume (effective porosity), better are the results. The present invention's technical concept of increasing the fraction of closed voids is lacking. Since the sintered magnet described in the patent publication mainly contains open pores, resin impregnation is essential to insure corrosion resistance and additionally, the resin must penetrate into open pores extending to the deep inside of the magnet, resulting in a substantial lowering of productivity. In Example of the patent publication, for example, vacuum evacuation is followed by 2 hours of resin impregnation, impregnation is continued for a further 2 hours under pressure, and subsequent resin curing treatment takes 2 hours.

Although the present invention adds an R-rich powder of a selected composition in order to form closed voids so that coercivity is improved, the method of the above-cited patent publication forms open pores using sintering inhibitors and gasifying agents as mentioned above so that R is poorly dispersed in a magnet and coercivity is insufficient. If the R content of a magnet is increased for improving coercivity, on the other hand, the remanence becomes insufficient. The size of the sintering inhibitor is described nowhere in the patent publication. Note that the patent publication describes that a metal powder of Tb or Dy may be added for coercivity improvement insofar as the fired body does not shrink to a substantial extent. However, since metals Tb and Dy have a melting point of 1,357° C. and 1,4070° C., respectively, they are not as effective as the grain boundary phase-forming master alloy powder having a low melting point used in the present invention. Moreover, the particle size range of metals Tb and Dy is disclosed nowhere in the patent publication and no examples of adding them are reported.

The above-cited patent publication describes that the Nd—Fe—B alloy has a preferred mean particle size of 2 to 20 μm and uses a fine powder of 3.5 μm in Examples. While the density of a compact prior to firing is not described in the patent publication, the pressure applied during compacting is as low as 0.2 to 5 t/cm$^2$, from which fact it is deemed that high density compacts are not produced. The method of the patent publication is different from the present invention in these regards too.

JP-A 230959/1985 discloses a method of sintering a mixture of an Nd—Fe—B alloy powder and an Nd—Co alloy powder (mean particle size 3 to 7 μm). A dense sintered magnet having a density of 7.4 g/cm$^3$ was produced in Example of this patent publication. This is completely different from the present invention of forming closed voids.

JP-A 93841/1988 discloses a method of sintering a mixture of an R—T—B system alloy powder and an R—X alloy powder wherein X is Fe or a mixture of Fe and at least one of B. Al, Ti, V, Co, Zr, Nb and Mo. This R—X alloy powder is prepared by quenching a melt and serves as a sintering aid. In Example of the patent publication, the mixture was compacted under 1 t/cm$^2$ and sintered at 1,000° to 1,200° C. to produce a dense sintered magnet having a density of 7.43 g/cm$^3$. The patent publication describes Examples using an R—X alloy powder of 1 to 500 μm, but the sintered magnets obtained in the Examples are dense as demonstrated by a density of 7.43 g/cm$^3$. The patent publication lacks the technical concept of intentionally forming voids to minimize shrinkage during sintering.

JP-A 278208/1988 discloses that an $R_2T_{14}B$ system magnet alloy is prepared according to powder metallurgy by sintering a powder compact containing 0 to 70% by volume of a melt quenched alloy powder having a composition wherein Pr, Tb or Dy occupies 32 to 100% by weight or an alloy powder obtained from ribbons (amorphous and microcrystalline). Although this method belongs to a two alloy route using an R-rich powder, the R-rich powder used in Example of the patent publication is a fine powder having a mean particle size of 3 to 5 μm so that no closed voids are formed upon sintering.

JP-A 21219/1993 discloses a method of mixing an alloy A consisting of an $R_2T_{14}B$ phase with an alloy B containing R, CoFe and B and having an R-rich phase, followed by sintering. In Examples of the patent publication, both the alloys are comminuted to a mean particle size of about 5 μm and all the sintered bodies obtained therefrom are dense as shown by a density of more than 7.42 g/cm$^3$. This is opposed to the present invention. JP-A 114939/1988 discloses a method for preparing a composite type magnet material comprising the steps of mixing a matrix material powder containing a low melting element (at least one of Al, Zn, Sn, Cu, Pb, S, In, Ga, Ge, and Te) or a high melting element with an $R_2T_{14}B$ system magnetic powder to form a powder mixture and compacting the powder mixture to form a magnet. The magnet forming step includes steps of compacting the powder mixture followed by sintering or a hot compression step of subjecting the powder mixture to hot compression to form a compact. The hot compression is preferably preceded by pre-forming. The sintering temperature is a temperature higher than the melting point of the matrix material and lower than 1150° C., the hot compression temperature is 300° to 1,100° C., and the hot compression pressure is 5 to 5,000 kgf/cm$^2$. The task of the patent publication is to improve a dimensional yield and it is described therein that the dimensional yield of a product can be improved by the hot compression technique. However, all the samples after sintering or hot compression had a density of 7.1 g/cm$^3$ or more in Examples of the patent publication while the density of compacts prior to sintering or hot compression is described nowhere. In Examples of the patent publication, the $R_2T_{14}B$ system magnetic powder had a small size as shown by a mean particle size of 3 to 4 $\mu$m, while the matrix material powder containing a low melting element had a small size as shown by a maximum size of 20 to 30 $\mu$M. The patent publication includes a Comparative Example in which hot compression molding is carried out using aluminum having a mean particle size of 100 $\mu$m as the matrix material, resulting in a dense magnet having a density of 7.5 g/cm$^3$. Both the compacting pressure and the preforming pressure used in Examples of the patent publication are as low as 1.5 t/cm$^2$ or less.

JP-A 80508/1991 discloses a method for preparing an RFeB system magnet by powder metallurgy, comprising the steps of press molding a magnet powder, firing at a temperature in the range of 400° to 900° C. to form a porous sintered body, and immersing the sintered body in a molten alloy $Nd_xFe_{1-x}$ wherein x=0.65 to 0.85 for a certain time. This method intends to suppress deformation after sintering caused by anisotropic thermal shrinkage due to magnetic field orientation. However, this method does not rely on the two alloy route or use an R oxide powder. Since the molten R-rich alloy is infiltrated into the sintered body, this method is not deemed to achieve the advantages of the fourth method of the present invention. Additionally, the $Nd_2Fe_{14}B$ magnet powder used in Example of this patent publication has a small size of about 10 $\mu$m while the compacting pressure, compact density and the density of a porous sintered body after low-temperature sintering are described nowhere.

JP-A 15224/1980 discloses a method for preparing 2–17 system magnets such as $Sm_2Co_{17}$ and $Pr_2Co_{17}$ comprising the steps of calcining a compact at 400° to 900° C. and impregnating it with a liquid plastic. This method intends to improve the strength of magnets. Described in Examples of the patent publication are a shrinkage factor of 7% when a compact of particles of 5 to 30 $\mu$m was sintered at 800° C. and a shrinkage factor of about 12 to 15% when it was completely sintered at 1,150° C. It is also described that after a calcined body was immersed in an epoxy resin and solidified, the density was 6.80 g/cm$^3$. However, this method does not rely on the two alloy route and its magnet composition is distinct from the present invention. The patent publication describes the use of particles having a small size of 5 to 30 $\mu$m while it does not disclose the density of a compact prior to calcining.

JP-A 281307/1987 discloses a method comprising the steps of subjecting an Nd—Fe—B system alloy ingot to solid solution treatment at a temperature in the range of 1,000° to 1,150° C., pulverizing the treated ingot to a particle size of less than 200 $\mu$m, and annealing a compact of the pulverized alloy powder at a temperature in the range of 500° to 1,050° C. and a method further comprising the steps of impregnating the annealed compact with a plastic followed by solidification. The compact is annealed at 500° to 1,050° C. in this method for the purpose of releasing pulverization strains for improving coercivity. In Example of the patent publication, an alloy powder having a small size (mean particle size 5 $\mu$m) was compacted under a low pressure (2 t/cm$^2$) and annealed. The density of a compact and the density of a sintered body are disclosed nowhere in the patent publication.

JP-A 314307/1992 discloses a method for preparing a bulk body for a bonded magnet comprising the steps of pulverizing an alloy containing a rare earth element, iron and boron as basic components, compacting the powder in a magnetic field and sintering. In this method, a bulk body of semi-sintered alloy having a density corresponding to 60 to 95% of the theoretical density is prepared by sintering at a temperature of 700° to 1,000° C. within 3 hours. The semi-sintered alloy is a structure containing a substantial fraction of voids which become nuclei for the propagation of cracks and nuclei for breakage so that it can be readily ground with low stresses. Then the influence of mechanical strain during grinding is minimized. In Example of the patent publication, a fine powder having a mean particle size of 3 $\mu$m is compacted and then semi-sintered to produce a bulk body. In this Example, the density of the compact and the shrinkage factor upon semi-sintering are not described. The invention of said patent publication is different from the present invention in that the two alloy route is not used and that a bonded magnet is produced by pulverizing a bulk body of semi-sintered alloy. The bulk body of semi-sintered alloy in Example of said patent publication has a density of less than 5.6 g/cm$^3$ which is approximately equal to the density of compacts in the present invention. Accordingly, the bulk body of semi-sintered alloy described in said patent publication cannot be used as a bulk magnet because it has a too high porosity so that magnetic properties and strength are short. That is, pulverization and processing into a bonded magnet are essential. This results in deteriorated coercivity and an increased manufacturing cost.

Further JP-A 314315/1992 discloses a method for preparing a bonded magnet comprising the steps of compacting in a magnetic field a bulk body of semi-sintered alloy as described in JP-A 314307/1992 and impregnating the compact with a resin. The compacting step in a magnetic field in this method serves for both pulverization and molding of a bulk body of semi-sintered alloy. It is described in this patent publication that as opposed to conventional sintered bodies having a deflective strength of more than 2.5 t/cm$^2$, a bulk body of semi-sintered alloy has a very low deflective strength of less than 1 t/cm$^2$ and is thus easy to pulverize. In Example of said patent publication, a fine powder having a mean particle size of 3 $\mu$m is compacted and semi-sintered to produce a bulk body having a density of less than 5.2 g/cm$^3$ as in JP-A 314307/1992, which is compression molded and impregnated with a resin to produce a bonded magnet having a density of 5.6 to 6.0 g/cm$^3$. Since the bulk body of semi-sintered alloy described in said patent publication has a lower density than the semi-sintered alloy described in JP-A 314307/1992, it cannot be used as a bulk magnet without carrying out compression molding and resin impregnation. This results in deteriorated coercivity and 20 an increased manufacturing cost.

JP-A 289605/1986 disclose a method for preparing a rare earth-iron-boron permanent magnet by mixing a particulate rare earth oxide. Allegedly, coercivity can be improved by adding a rare earth oxide. However, the description of closed voids is lacking in the patent publication while the densities of both compacts and magnets are disclosed nowhere. Since a magnet powder having a small size of 5 to 10 $\mu$m is used and the compacting pressure is as low as about $7\times10^7$ Newton/m$^2$ (about 0.71 t/cm$^2$) in Example of the patent publication, it is presumed that the resulting compact has a density as in the prior art.

JP-A 41652/1992 discloses a rare earth magnet alloy containing 0.1 to 1.0% by weight of a light rare earth oxide ($La_2O_3$, $Ce_2O_3$, $Pr_2O_3$, $Nd_2O_3$, and $Sm_2O_3$). Allegedly, corrosion resistance is improved by adding a light rare earth oxide to a rare earth magnet alloy. However, the description of closed voids is lacking in the patent publication while the densities of both compacts and magnets are disclosed nowhere. Since magnet particles having a small size of less than 3.2 μm are used and the compacting pressure is as low as about 1.0 t/cm$^2$ in Example of the patent publication, it is presumed that the resulting compact has a density as in the prior art.

Comparison of inventive method with prior art methods

The prior art semi-sintered alloys mentioned above include one example using a powder of a 2–17 system magnet such as $Sm_2Co_{17}$ in the form of particles of 30 μm while the $R_2T_{14}B$ system magnets are prepared by semi-sintering a compact of a magnet powder in the form of small sized particles having a mean particle size of approximately 3 μm. When a compact of small sized particles is semi-sintered, heat treatment should be made at a lower temperature than that employed for complete sintering. In such a lower temperature range, the density of a sintered body largely varies with a change of the holding temperature. Namely, a strict temperature control is required in order to produce a semi-sintered body having a predetermined density, resulting in an increased manufacturing cost.

In contrast, the first method of the present invention is different from the prior art methods in that a two alloy route using an R-rich powder of a large size is utilized and that a powder of a large size is used to form the primary phase of a magnet. Since particle migration through a rare earth element-rich liquid phase is difficult in a compact containing a primary phase-forming powder of a large size, the sintering reaction ceases to proceed before complete sintering even when the holding temperature of the sintering step is a high temperature (for example, in the conventional complete sintering temperature range). As a result, a sintered body having a predetermined low density is consistently obtained over a wide temperature range to considerably facilitate the management of the sintering step. Since the use of large sized particles allows a compact to be readily increased in density under a low pressure, the effect of inhibiting sintering reaction is also improved. Furthermore, large sized particles are unlikely to agglomerate and hence, easy to handle, especially easy to fill in a mold for compacting.

The second method also achieves advantages as mentioned above since a large sized magnet powder having a mean particle size of at least 70 μm is used. The first method of using a large sized alloy powder having a mean particle size of at least 70 μm to form a high density compact and semi-sintering the compact which is used as a bulk magnet is novel over the prior art and not taught by the prior art method utilizing semi-sintering.

The third method is different from the prior art method for preparing a semi-sintered magnet in that an R oxide powder is added and a compact has an increased density. Since particle migration through a rare earth element-rich liquid phase is difficult in a high density compact, the sintering reaction ceases to proceed before complete sintering even when the holding temperature of the sintering step is a high temperature (for example, in the conventional complete sintering temperature range). As a result, a sintered body having a predetermined low density is consistently obtained over a wide temperature range to considerably facilitate the management of the sintering step. When a powder of primary phase-forming master alloy having a large size is used, advantages as mentioned above are achieved.

In the prior art two alloy route, an R-rich powder is localized. Since the R-rich powder is melted in a compression molded compact, the flow of the liquefied R-rich alloy is disturbed, resulting in an insufficiently uniform dispersion of the R-rich phase in the magnet. In contrast, the fourth method solves this problem by melting the grain boundary phase-forming master alloy prior to compression molding, offering a sintered magnet having high coercivity and high remanence.

ILLUSTRATIVE CONSTRUCTION

Figure 1A:
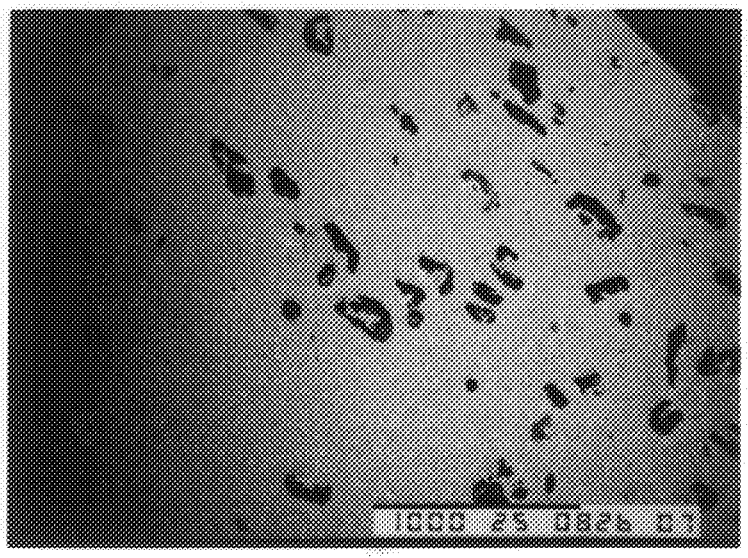
FIGS. 1(*a*) and 1(*b*) are figure-substitute photographs showing crystal structures, that is, scanning electron microscope photographs of a section of a sintered magnet according to the invention.

The illustrative construction of the present invention is described below in detail.

Sintered magnet

The sintered magnet of the invention contains R, T and B wherein R is at least one element of rare earth elements inclusive of yttrium (Y) and T is iron (Fe) or iron (Fe) and cobalt (Co).

Although the magnet composition is not particularly limited, as a general rule, the magnet prepared by the first or third method preferably has a composition consisting essentially of 30 to 45% by weight of R, 0.5 to 3.5% by weight of B, and the balance of T, and the magnet prepared by the second or fourth method preferably has a composition consisting essentially of 27 to 40% by weight of R, 0.5 to 4.5% by weight of B, and the balance of T.

R elements include lanthanides and actinides. At least one of Nd, Pr, and Tb is preferred as R, with Nd being especially preferred and additional inclusion of Dy being more preferred. It is also preferred to include at least one of La, Ce, Gd, Er, Ho, Eu, Pm, Tm, Yb, and Y. Mixtures of rare earth elements such as misch metal may also be used as raw materials of rare earth elements. Too small R contents would allow an iron-rich phase to precipitate to prohibit high coercivity whereas high remanence (residual magnetic flux density) would be lost with too large R contents.

High coercivity would be lost with too small B contents whereas high remanence would be lost with too large B contents.

Note that the amount of cobalt in T should preferably be 30% by weight or less.

Elements such as Al, Cr, Mn, Mg, Si, Cu, C, Nb, Sn, W, V, Zr, Ti and Mo may be added for improving coercivity, but their addition in excess of 6% by weight would give rise to the problem of a remanence loss.

In the magnet, incidental impurities or trace additives, for example, carbon and oxygen may be contained in addition to the aforementioned elements.

The sintered magnet of the invention has a primary phase essentially of a tetragonal system crystal structure and an R-rich phase having a higher R proportion than $R_2T_{14}B$ is present in the grain boundary. The magnet has an average crystal grain size which depends on the crystal grain size of the primary phase-forming master alloy and sintering conditions, which will be described later.

The sintered magnet of the invention contains closed voids. The closed voids are voids which do not communicate to the magnet surface. The closed voids occupy 2 to 15% by volume, preferably 3 to 15% by volume, more preferably 3 to 12% by volume of the magnet. A magnet with less closed voids has considerably shrunk during sintering and does not maintain the dimensional accuracy of a compact. A magnet with more closed voids has insufficient magnet properties and poor strength. The total volume fraction of closed voids in the magnet as well as the total volume fraction of open voids to be described later can be calculated as follows.

Total volume fraction of open voids K $$K=(Ww-W)/V \quad \text{equation I}$$

Total volume fraction of closed voids H $$H=1-K-W/(V\cdot\rho) \quad \text{equation II}$$

Note that V, W, Ww and ρ in the equations are:

V: a volume calculated from the shape of a sample,

W: a weight of the sample,

Ww: the weight of the sample after it is immersed in water, vacuumed to 100 Torr or lower, held for 30 seconds, taken out of water, and wiped off water from the surface, ρ: the theoretical density of the magnet.

The shape and dimensions of closed voids are not particularly limited although it is preferred that the closed voids each have an average projection cross-sectional area of 1,000 to 30,000 $\mu m^2$. Since small closed voids, if formed at the initial of sintering, extinguish until the end of sintering, it is generally unlikely that the average projection cross-sectional area of a closed void is less than 1,000 $\mu m^2$. Differently stated, if one intends to form closed voids having an average projection cross-sectional area of less than 1,000 $\mu m^2$, over-sintering would take place without forming closed voids so that the total volume of closed voids is reduced, failing to reduce the shrinkage factor. Also note that crystal grains adjacent to closed voids are low in coercivity. If the average volume per closed void is small in a magnet of the identical density, more crystal grains are adjacent to the closed voids, failing to provide high coercivity. Inversely, if the average projection cross-sectional area is too large, a magnet would have insufficient strength. Also, since giant particles of the grain boundary phase-forming master alloy must be used in order to form closed voids having an average projection cross-sectional area in excess of 30,000 $\mu m^2$, a thin wall magnet is difficult to mold and the surface magnetic flux of a magnet tends to become uneven. The cross-sectional area of closed voids can be measured using a scanning electron microscopic photograph of a magnet section. Measurement is carried out by cutting the magnet, polishing the section, forming a sputtered film of gold on the section, and taking a photograph thereof. The cross-sectional areas of arbitrary 100 or more closed voids per magnet are measured and averaged, which value is the average projection cross-sectional area per closed void.

The sintered magnet of the invention preferably has a density of up to 7.2 g/cm$^3$, more preferably up to 7.15 g/cm$^3$. If particles of a relatively large size are used and molded under a high pressure, a compact can have a high density of about 6.4 g/cm$^3$. However, since particles can migrate across such a compact with difficulty during sintering, it is difficult to achieve a density in excess of 7.2 g/cm$^3$ even by high-temperature sintering. Inversely, if particles of a relatively small size are used and molded into a compact having a low density, firing to reach a density in excess of 7.2 g/cm$^3$ results in over-sintering to provide an increased shrinkage factor. Even when a sintered magnet has a density within the above-defined range, a sintered magnet in which many open voids communicate to the magnet surface is undesirable because the magnet is extremely low in corrosion resistance. The fraction of open voids is preferably up to 2% by volume. The fraction of open voids is determined by the above-mentioned procedure.

First method

The sintered magnet of the invention is preferably prepared by the first method which is described below. The first method includes a compacting step of forming a compact from a mixture of a powder of a primary phase-forming master alloy and a powder of a grain boundary phase-forming master alloy and a sintering step of sintering the compact.

Primary phase-forming master alloy

Although the composition of a primary phase-forming master alloy may be properly determined in accordance with the desired magnet composition by taking into account the composition of a grain boundary phase-forming master alloy and its mixing ratio, as a general rule, the primary phase-forming master alloy has a preferred composition consisting essentially of 26 to 35% by weight of R, 0.5 to 3.5% by weight of B, and the balance of T.

In $R_2T_{14}B$ system magnets, the R-rich phase turns into a liquid phase to flow to drive sintering reaction. In the first method wherein a powder of an R-rich grain boundary phase-forming master alloy is added and the progress of sintering reaction must be retarded in order to suppress the shrinkage factor, the R content of the primary phase-forming master alloy should preferably be low.

The primary phase-forming master alloy has the primary phase and R-rich phase both mentioned above. The mean crystal grain size of the primary phase-forming master alloy powder is not particularly limited. Since orientation of powders is imparted by magnetic field according to the invention, the crystal grain size is preferably selected such that single crystal particles are obtained when the particle size to be described below is achieved. Even in the case of polycrystalline particles, it suffices that crystal grains are oriented in the particles. Then the mean crystal grain size may be selected from a wide range, for example, of about 3 to 600 $\mu m$.

The powder of primary phase-forming master alloy preferably has a mean particle size of at least 20 $\mu m$, more preferably 50 to 350 $\mu m$. With a too small mean particle size, the aforementioned effects of large sized particles would become insufficient. With a too large mean particle size, magnetic field orientation would be difficult in a thin wall compact. It is to be noted that the mean particle size of the primary phase-forming master alloy powder is the diameter of a circle equivalent to a calculated average projection area per particle. The way of measuring the projection area of particles is not critical. For example, a liquid dispersion of powder is applied onto a glass plate such that particles may not overlap each other, a photograph of the coating is taken, and the projection area of particles is determined from the photograph. Alternatively, the coating is scanned with a light beam to detect reflectance changes, from which the projection area of particles is determined.

Although the technique of preparing the powder of primary phase-forming master alloy is not critical, it may be prepared by occluding hydrogen into a cast alloy followed by pulverizing into a powder, using a reduction and diffusion technique, or pulverizing a sintered magnet into a powder. If a sintered magnet which has been made anisotropic by magnetic field orientation is pulverized, there are available large sized polycrystalline particles consisting of oriented small size crystal grains, from which a magnet having high remanence and high coercivity can be obtained.

Grain boundary phase-forming master alloy

The grain boundary phase-forming master alloy consists essentially of 70 to 97% by weight, preferably 75 to 92% by weight of R and the balance of iron and/or cobalt. Neodymium (Nd) is preferred as R contained in the grain boundary phase-forming master alloy, more preferably Nd occupies at least 50% of the R component, most preferably R consists essentially of Nd. If the Nd content in the R component is low and if the R content is low, a grain boundary phase-forming master alloy would not have a low melting point and closed voids would be unlikely to form. Note that $Nd_{89}Fe_{11}$ (weight ratio) eutectic alloy has a melting point of 640° C. and $Nd_{81}Co_{19}$ (weight ratio) eutectic alloy has a melting point of 566° C. while $Dy_{88}Fe_{12}$ (weight ratio) eutectic alloy has a melting point of 890° C. The grain boundary phase-forming master alloy used herein is free of boron (B). Boron in the grain boundary phase-forming master alloy does not contribute to an improvement in magnet properties and a lowering of the melting point thereof.

The powder of grain boundary phase-forming master alloy used in the first method is left on a screen having an opening of at least 38 μm, preferably an opening of at least 53 μm, but passes a screen having an opening of up to 500 μm, preferably an opening of up to 250 μm. If the grain boundary phase-forming master alloy powder has a smaller particle size, a magnet having a specific fraction of closed voids is not obtained and the grain boundary phase-forming master alloy powder is susceptible to oxidation. If the grain boundary phase-forming master alloy powder has a larger particle size, there would occur larger voids and a non-uniform surface magnetic flux. If the size of voids left in a magnet is too large relative to the size of the magnet, no sufficient magnet strength would be available.

Although the technique of preparing the powder of grain boundary phase-forming master alloy is not critical, a liquid quenching technique is preferably used. The preferred liquid quenching technique is a technique of cooling a molten alloy by contacting with a chill substrate, for example, a single roll technique, twin roll technique, and rotary disk technique although a gas atomizing technique is also acceptable. The molten alloy is cooled in a non-oxidizing atmosphere of nitrogen or argon or in vacuum. With a slow cooling rate, the grain boundary phase-forming master alloy of the above-mentioned composition separates into mainly Nd and $Fe_2Nd$ phases. Since these phases have a high melting point above 1,000° C. and Nd is susceptible to oxidation, formation of closed voids becomes difficult. The grain boundary phase-forming master alloy prepared by the liquid quenching technique has an amorphous or micro-crystalline phase.

Pulverizing and mixing steps

It is not critical how to produce a mixture of a primary phase-forming master alloy powder and a grain boundary phase-forming master alloy powder. Such a mixture may be prepared, for example, by mixing the two master alloys and pulverizing the alloys together, or by pulverizing the two master alloys separately, mixing the pulverized master alloys, and optionally finely milling the mixture.

The proportion of the grain boundary phase-forming master alloy in the mixture is preferably 2 to 20% by weight, more preferably 3 to 12% by weight. A too low proportion would make it difficult to form sufficient closed voids in a magnet whereas a too high proportion would make it difficult to produce a magnet with excellent properties.

It is not critical how to pulverize the respective master alloys. A proper choice may be made of mechanical pulverization and hydrogen occlusion-assisted pulverization techniques while pulverization may be done by a combination of such techniques. The hydrogen occlusion-assisted pulverization technique is preferred because a magnet powder having a sharp particle size distribution is obtained. For mechanical pulverization, a pneumatic type of pulverizer such as a jet mill is preferably used because a sharp particle size distribution is obtained.

Compacting step

In the compacting step, a mixture of the two master alloy powders is compacted in a magnetic field. Preferably the mixture is compacted such that a compact may have a density of at least 5.5 g/cm$^3$, more preferably at least 6.0 g/cm$^3$. A compact with a lower density is less desirable in that sufficient magnet properties can be achieved concomitant with an increased shrinkage factor during sintering and that a low shrinkage factor during sintering can be achieved concomitant with insufficient magnet properties. Although no particular upper limit is imposed on the density of a compact, it is difficult to achieve a density in excess of 6.4 g/cm$^3$. For example, a ultra-high pressure of higher than 20 t/cm$^2$ is necessary during compacting, and therefore, an expensive molding machine and mold must be used and a compact is limited to a simple shape. Although the use of a large amount of organic lubricant is effective for increasing the density of a compact, it is difficult to remove the organic lubricant before sintering, with the residual carbon in the magnet detracting from magnet properties. It is noted that the density of a compact can be calculated from the dimensions of the compact measured by a micrometer or the like.

Since the compact having such a high density has a deflective strength of at least 0.3 kgf/mm$^2$, especially at least 0.5 kgf/mm$^2$, it is easy to handle and less liable to cracking and chipping.

No particular limit is imposed on the compacting pressure and it may be properly determined so as to produce a compact with a desired density. Preferably the compacting pressure is at least 6 t/cm$^2$, more preferably at least 8 t/cm$^2$, most preferably at least 12 t/cm$^2$. The magnetic field applied during compacting generally has a strength of at least 10 kOe, preferably at least 15 kOe.

The magnetic field applied during compacting may be a DC magnetic field or a pulse magnetic field or a combination thereof. The invention is applicable to both a so-called transverse magnetic field compacting technique wherein the direction of an applied pressure is substantially perpendicular to the direction of an applied magnetic field and a so-called longitudinal magnetic field compacting technique wherein the direction of an applied pressure is substantially coincident with the direction of an applied magnetic field.

Sintering step

The thus obtained contact is sintered into a magnet.

In the first method, sintering is preferably effected so that the density of a sintered body minus the density of a compact (a density change during sintering) may be at least 0.2 g/cm$^3$. A too small density change in the sintering step would indicate short sintering, resulting in insufficient magnet properties and mechanical strength. In order to achieve a low shrinkage factor, the density change should preferably be 1.5 g/cm$^3$ or less, more preferably 1.2 g/cm$^3$ or less.

Various conditions during sintering are not particularly limited and they may be properly selected so as to achieve a desired density change during sintering. The holding temperature during sintering is at or above the melting temperature of the grain boundary phase-forming master alloy. Since a low density magnet is formed according to the invention using a grain boundary phase-forming master alloy powder of a large size as previously described, the holding temperature can be higher than the prior art so-called semi-sintering processes. More illustratively, heat treatment is preferably effected at 900° to 1,100° C. for ½ to 10 hours for sintering, followed by quenching. The sintering atmosphere is preferably an inert gas atmosphere of argon gas or the like or vacuum. Sintering in vacuum or in an inert gas atmosphere of reduced pressure is more preferred because the fraction of open voids can be reduced as previously described. It is noted that only a portion of the sintering step may be done in vacuum or in a reduced pressure atmosphere.

Miscellaneous

After sintering, aging treatment is carried out for improving coercivity, if necessary.

In order to improve the corrosion resistance of a magnet, it is preferred to plug up open voids. To this end, the magnet may be immersed in a solution of a resin in an organic solvent and then dried. It is understood that after such a treatment, a conventional anti-corrosion coating may be provided by electrodeposition coating or electroless plating of a resin.

The preparation method of the invention is suited for the manufacture of thin wall ring- and plate-shaped magnets, especially for the manufacture of thin wall magnets having a thickness of up to 3 mm. There is the likelihood that magnets of less than 0.5 mm thick be compacted with difficulty.

Second method

The sintered magnet of the invention may also be prepared by the second method which is described below. According to the second method, a sintered magnet containing R, T and B is prepared by a compacting step of forming a compact of a magnet powder and a sintering step of sintering the compact.

Magnet powder

Preferably the magnet powder consists essentially of 27 to 40% by weight of R, 0.5 to 4.5% by weight of B, and the balance of T.

Too low R contents would allow an iron-rich phase to precipitate, failing to provide high coercivity. Too high R contents fail to provide high remanence. Since the R-rich phase turns into a liquid phase to flow to drive sintering reaction in $R_2T_{14}B$ system magnets, the second method favors to reduce the R content in order to restrain the progress of sintering reaction. Illustratively, the preferred composition consists essentially of 28 to 35% by weight of R.

0.7 to 3% by weight of B, and the balance of T.

High coercivity would not be achieved with too low B contents whereas high remanence would not be achieved with too high B contents.

The magnet powder of the composition defined above has a primary phase essentially of a tetragonal system crystal structure and an R-rich phase having a higher R proportion than $R_2T_{14}B$ is present in the grain boundary. The average crystal grain size of the magnet powder is not critical. Since anisotropy is imparted by magnetic field orientation according to the invention, the crystal grain size is preferably selected such that single crystal particles are obtained when the particle size to be described below is achieved. Even in the case of polycrystalline particles, it suffices that crystal grains are oriented in the particles. Then the mean crystal grain size may be selected from a wide range, for example, of about 3 to 600 $\mu$m.

The magnet powder has a mean particle size of 70 to 350 $\mu$m, preferably 100 to 350 $\mu$m. With a mean particle size of less than 70 $\mu$m, the aforementioned effects of large sized particles would become insufficient. With a too large mean particle size, magnetic field orientation would be difficult in a thin wall compact. It is to be noted that the mean particle size of the magnet powder is calculated by the aforementioned procedure.

Although the technique of preparing the magnet powder is not critical, it may be prepared by occluding hydrogen into a cast alloy followed by pulverizing into a powder, using a reductive diffusion technique, or pulverizing a sintered magnet into a powder. If a sintered magnet which has been made anisotropic by magnetic field orientation is pulverized, there are available large sized polycrystalline particles consisting of oriented small size crystal grains, from which a magnet having high remanence and high coercivity can be obtained.

Compacting step

In the compacting step, the magnet powder is compacted in a magnetic field to form a compact having a density of at least 5.5 g/cm$^3$, preferably at least 6.0 g/cm$^3$. A compact with a lower density is less desirable in that sufficient magnet properties can be achieved concomitant with an increased shrinkage factor during sintering and that a low shrinkage factor during sintering can be achieved concomitant with insufficient magnet properties. Although no particular upper limit is imposed on the density of a compact, it is difficult to achieve a density in excess of 6.4 g/cm$^3$. For example, a ultra-high pressure of higher than 20 t/cm$^2$ is necessary during compacting, and therefore, an expensive molding machine and mold must be used and a compact is limited to a simple shape. Although the use of a large amount of organic lubricant is effective for increasing the density of a compact, it is difficult to remove the organic lubricant before sintering, with the residual carbon in the magnet detracting from magnet properties. It is noted that the density of a compact can be calculated by the aforementioned procedure.

Since the compact having such a high density has a deflective strength of at least 0.3 kgf/mm$^2$, especially at least 0.5 kgf/mm$^2$, it is easy to handle and less liable to cracking and chipping.

The compacting pressure and the magnetic field applied during compacting are the same as in the first method.

Sintering step

The thus obtained contact is sintered into a magnet.

In the second method, sintering is effected so that the density of a sintered body minus the density of a compact (a density change during sintering) may be at least 0.2 g/cm$^3$. A too small density change in the sintering step would indicate short sintering, resulting in insufficient magnet properties and mechanical strength. In order to achieve a low shrinkage factor, the density change should preferably be 1.5 g/cm$^3$ or less, more preferably 1.2 g/cm$^3$ or less.

Various conditions during sintering are not particularly limited and they may be properly selected so as to achieve a desired density change during sintering. Since the second method uses a magnet powder of a large size as previously described, the holding temperature can be higher than the prior art so-called semi-sintering processes. More illustratively, heat treatment is preferably effected at 900° to 1,100° C. for ½ to 10 hours for sintering, followed by quenching. The sintering atmosphere is preferably vacuum or a non-oxidizing gas atmosphere of argon gas or the like.

Treatments after sintering are the same as in the first method.

Third method

The sintered magnet of the invention may also be prepared by the third method which is described below. A first embodiment of the third method includes a compacting step of producing a compact of a mixture of a powder of a primary phase-forming master alloy (magnet powder) and a powder of an R oxide. A second embodiment of the third method includes a compacting step of producing a compact of a mixture of a powder of a primary phase-forming master alloy, a powder of a grain boundary phase-forming master alloy, and a powder of an R oxide.

Primary phase-forming master alloy

The composition of a primary phase-forming master alloy may be properly determined in accordance with the desired magnet composition in the first embodiment or by further taking into account the composition of a grain boundary phase-forming master alloy and its mixing ratio in the second embodiment. As a general rule, the first embodiment uses a preferred composition consisting essentially of 27 to 40% by weight of R, 0.5 to 4.5% by weight of B, and the balance of T;

and the second embodiment uses a preferred composition consisting essentially of 26 to 35% by weight of R, 0.5 to 3.5% by weight of B, and the balance of T.

In $R_2T_{14}B$ system magnets, the R-rich phase turns into a liquid phase to flow to drive sintering reaction. In the second embodiment wherein a powder of an R-rich grain boundary phase-forming master alloy is added and the progress of sintering reaction must be retarded in order to suppress the shrinkage factor, the R content of the primary phase-forming master alloy should preferably be low.

The primary phase-forming master alloy has the primary phase and R-rich phase both mentioned above. The mean crystal grain size of the primary phase-forming master alloy powder is not particularly limited. Since anisotropy is imparted by magnetic field orientation according to the invention, the crystal grain size is preferably selected such that single crystal particles are obtained when the particle size to be described below is achieved. Even in the case of polycrystalline particles, it suffices that crystal grains are oriented in the particles. Then the mean crystal grain size may be selected from a wide range, for example, of about 3 to 600 μm.

The powder of primary phase-forming master alloy preferably has a mean particle size of at least 30 μm, more preferably 50 to 350 μm. With a too small mean particle size, the aforementioned effects of large sized particles would become insufficient. With a too large mean particle size, magnetic field orientation would be difficult in a thin wall compact. It is to be noted that the mean particle size of the primary phase-forming master alloy powder is calculated by the aforementioned procedure.

Although the technique of preparing the powder of primary phase-forming master alloy is not critical, it may be prepared by occluding hydrogen into a cast alloy followed by pulverizing into a powder, using a reductive diffusion technique, or pulverizing a sintered magnet into a powder.If a sintered magnet which has been made anisotropic by magnetic field orientation is pulverized, there are available large sized polycrystalline particles consisting of oriented small size crystal grains, from which a magnet having high remanence and high coercivity can be obtained.

R oxide

A powder of R oxide is added in order to suppress sintering reaction. The R oxide powder used in the second method is not particularly limited. For example, use may be made of the powders of oxides of rare earth elements described in connection with the magnet composition. Two or more oxide powders may be used although at least one oxide of $Nd_2O_3$, $Dy_2O_3$, $Pr_6O_{11}$, $Tb_4O_7$, $Y_2O_3$, and $CeO_2$ is preferably used. When at least one of the oxides of Pr, Tb and Dy which exhibit a high magnetic anisotropy constant in $R_2T_{14}B$ form is used among these oxides, the oxide is reduced by excess R in the primary phase-forming master alloy and R in the grain boundary phase-forming master alloy whereby at least one of Pr, Tb and Dy diffuses into the primary phase to create $R_2T_{14}B$ having a high magnetic anisotropy constant, achieving high coercivity. Among the above-mentioned oxides, $Nd_2O_3$ and $CeO_2$ are inexpensive.

The mean particle size of R oxide powder is not particularly limited although it preferably ranges from 0.5 to 20 μm. Particles with a too small mean particle size would be caught by a die and punch of a mold during compacting and would be too small in particle size as compared with the primary phase-forming master alloy to achieve uniform mixing therewith. Inversely, a too large mean particle size disturbs dispersion in a mixture.

The R oxide may be prepared by oxidizing a metal R or commercially available R oxide particles may be used.

Grain boundary phase-forming master alloy

The grain boundary phase-forming master alloy used in the second embodiment consists essentially of 70 to 97% by weight, preferably 75 to 92% by weight of R and the balance of iron and/or cobalt. Neodymium (Nd) is preferred as R contained in the grain boundary phase-forming master alloy, more preferably Nd occupies at least 50% of the R component, most preferably R consists essentially of Nd. If the Nd content in the R component is low and if the R content is low, a grain boundary phase-forming master alloy would not have a low melting point and closed voids would be unlikely to form. The grain boundary phase-forming master alloy used herein is free of boron (B). Boron in the grain boundary phase-forming master alloy does not contribute to an improvement in magnet properties and a lowering of the melting point thereof.

The powder of grain boundary phase-forming master alloy used herein is left on a screen having an opening of at least 38 μm, preferably an opening of at least 53 μm, but passes a screen having an opening of up to 500 μm, preferably an opening of up to 250 μm. If the grain boundary phase-forming master alloy powder has a too smaller particle size, the average projection cross-sectional area of closed voids would be reduced, the total volume of closed voids would be insufficient, and the grain boundary phase-forming master alloy powder would be susceptible to oxidation. If the grain boundary phase-forming master alloy powder has a too larger particle size, there would occur larger voids and a non-uniform surface magnetic flux. If the size of voids left in a magnet is too large relative to the size of the magnet, no sufficient magnet strength would be available.

Although the technique of preparing the grain boundary phase-forming master alloy is not critical, a liquid quenching technique is preferably used as previously mentioned.

Pulverizing and mixing steps

In the first and second embodiment of the third method, it is not critical how to produce a mixture. In the second embodiment, a mixture may be prepared, for example, by mixing the two master alloys, pulverizing the alloys together, and adding an R oxide powder thereto. Alternatively a mixture may be prepared by pulverizing the two master alloys separately and mixing the master alloy powders and an R oxide powder, or finely milling a mixture of the master alloy powders and then adding an R oxide powder thereto.

The proportion of the R oxide powder in the mixture is preferably 0.5 to 10% by weight, more preferably 1 to 7% by weight. A too low proportion would be less effective for suppressing sintering, making it difficult to form sufficient closed voids in a magnet. With a too high proportion, a magnet would have low remanence.

The proportion of the grain boundary phase-forming master alloy in the mixture is preferably 2 to 20% by weight, more preferably 3 to 12% by weight. A too low proportion would make it difficult to form sufficient closed voids in a magnet whereas a too high proportion would make it difficult to produce a magnet with excellent properties.

It is not critical how to pulverize the respective master alloys. A proper choice may be made of mechanical pulverization and hydrogen occlusion-assisted pulverization techniques while pulverization may be done by a combination of such techniques. The hydrogen occlusion-assisted pulverization technique is preferred because a magnet powder having a sharp particle size distribution is obtained. For mechanical pulverization, a pneumatic type of pulverizer such as a jet mill is preferably used because a sharp particle size distribution is obtained.

Compacting step

In the compacting step, the above-mentioned mixture is compacted in a magnetic field. In the first embodiment, the mixture is preferably compacted such that a compact may have a density of at least 5.5 g/cm$^3$, more preferably at least 6.0 g/cm$^3$. Also in the second embodiment, the mixture is preferably compacted so as to form such a high density compact. A compact with a lower density is less desirable in that sufficient magnet properties can be achieved concomitant with an increased shrinkage factor during sintering and that a low shrinkage factor during sintering can be achieved concomitant with insufficient magnet properties. Although no particular upper limit is imposed on the density of a compact, it is difficult to achieve a density in excess of 6.4 g/cm$^3$. For example, a ultra-high pressure of higher than 20 t/cm$^2$ is necessary during compacting, and therefore, an expensive molding machine and mold must be used and a compact is limited to a simple shape. Although the use of a large amount of organic lubricant is effective for increasing the density of a compact, it is difficult to remove the organic lubricant before sintering, with the residual carbon in the magnet detracting from magnet properties. It is noted that the density of a compact can be calculated by the aforementioned procedure.

Since the compact having such a high density has a deflective strength of at least 0.3 kgf/mm$^2$, especially at least 0.5 kgf/mm$^2$, it is easy to handle and less liable to cracking and chipping.

The compacting pressure and the magnetic field applied during compacting are the same as in the first method.

Sintering step

The thus obtained contact is sintered into a magnet.

In the third method, sintering is preferably effected so that the density of a sintered body minus the density of a compact (a density change during sintering) may be at least 0.2 g/cm$^3$. A too small density change in the sintering step would indicate short sintering, resulting in insufficient magnet properties and mechanical strength. In order to achieve a low shrinkage factor, the density change should preferably be 1.5 g/cm$^3$ or less, more preferably 1.2 g/cm$^3$ or less.

Various conditions during sintering are not particularly limited and they may be properly selected so as to achieve a desired density change during sintering. In the second embodiment, the holding temperature during sintering is at or above the melting temperature of the grain boundary phase-forming master alloy. Since a high density compact containing an R oxide powder is sintered in the third method as previously described, the holding temperature can be higher than the prior art so-called semi-sintering processes. More illustratively, heat treatment is preferably effected at 900° to 1,100° C. for ½ to 10 hours for sintering, followed by quenching. The sintering atmosphere is preferably vacuum or an inert gas atmosphere of argon gas or the like. Sintering in vacuum or in an inert gas atmosphere of reduced pressure is more preferred because the fraction of open voids can be reduced as previously described. It is noted that only a portion of the sintering step may be done in vacuum or in a reduced pressure atmosphere.

Treatments after sintering are the same as in the first method.

Fourth method

The sintered magnet of the invention may also be prepared by the fourth method which is described below. According to the fourth method, a mixture of a powder of a primary phase-forming master alloy having a phase consisting essentially of $R_2T_{14}B$ and a powder of a grain boundary phase-forming master alloy consisting essentially of 70 to 97% by weight of R and the balance of iron and/or cobalt is heat treated such that the grain boundary phase-forming master alloy may melt, followed by disintegrating, compacting, and sintering.

Primary phase-forming master alloy

The composition of a primary phase-forming master alloy may be properly determined in accordance with the desired magnet composition by taking into account the composition of a grain boundary phase-forming master alloy and its mixing ratio. As a general rule, it has a preferred composition consisting essentially of 26 to 35% by weight of R, 0.5 to 3.5% by weight of B, and the balance of T.

Too low R contents would allow an iron-rich phase to precipitate, failing to provide high coercivity. Too high R contents would fail to provide high remanence.

In $R_2T_{14}B$ system magnets, the R-rich phase turns into a liquid phase to flow to drive sintering reaction. In the fourth method wherein an R-rich grain boundary phase-forming master alloy is added and the progress of sintering reaction is preferably retarded in order to suppress the shrinkage factor, the R content of the primary phase-forming master alloy should preferably be low.

High coercivity would not be achieved with too low B contents whereas high remanence would not be achieved with too high B contents.

Normally, the primary phase-forming master alloy has crystal grains containing a phase consisting essentially of $R_2T_{14}B$ and an R-rich grain boundary phase. The mean crystal grain size of the primary phase-forming master alloy powder is not particularly limited. Since anisotropy is imparted by magnetic field orientation according to the fourth method, the crystal grain size is preferably selected such that single crystal particles are obtained when the particle size to be described below is achieved. Even in the case of polycrystalline particles, it suffices that crystal grains are oriented in the particles. Then the mean crystal grain size may be selected from a wide range, for example, of about 3 to 600 $\mu$m.

The mean particle size of the primary phase-forming master alloy powder is not particularly limited. It may be determined such that a magnet as sintered may have a crystal grain size of a desired value, for example, properly selected from the range of about 5 to 500 $\mu$m. In order to reduce the shrinkage factor during sintering, a mean particle size of at least 20 $\mu$m, especially 50 to 350 $\mu$m is preferred. With a too small mean particle size, the aforementioned effects of large sized particles would become insufficient. With a too large mean particle size, magnetic field orientation would be difficult in a thin wall compact. It is to be noted that the mean particle size of the primary phase-forming master alloy powder is calculated by the aforementioned procedure.

Although the technique of preparing the powder of primary phase-forming master alloy is not critical, it may be prepared by occluding hydrogen into a cast alloy followed by pulverizing into a powder, using a reductive diffusion technique, or pulverizing a sintered magnet into a powder. A powder obtained by pulverizing a sintered magnet which has been made anisotropic by magnetic field orientation or chips resulting from the machining of such a sintered magnet offer large sized polycrystalline particles consisting of oriented small size crystal grains, from which a magnet having high remanence and high coercivity can be obtained. Also, the reductive diffusion technique or casting technique offers polycrystalline particles having well aligned easy axes of magnetization if preparation conditions are properly controlled.

Where the primary phase-forming master alloy powder is composed mainly of monocrystalline particles, their shape is preferably approximately isometric. Where the primary phase-forming master alloy powder is composed mainly of polycrystalline particles, the shape of crystal grains in the particles is preferably approximately isometric. The approximately isometric shape used in these embodiments means that the average value of major axis/minor axis of particles or crystal grains is preferably up to 3, more preferably up to 2.5. As monocrystalline particles are closer to an isometric shape, the ratio of the surface area per unit volume of particles is smaller and the damage near the particle surface caused in the magnet preparing process is diminished, resulting in a magnet with better properties. In the case of polycrystalline particles, better magnetic properties are obtained when they have crystal grains of approximately isometric shape.

Grain boundary phase-forming master alloy

The grain boundary phase-forming master alloy consists essentially of 70 to 97% by weight, preferably 75 to 92% by weight of R and the balance of iron and/or cobalt. Neodymium (Nd) is preferred as R contained in the grain boundary phase-forming master alloy, more preferably Nd occupies at least 50% of the R component, most preferably R consists essentially of Nd. If the Nd content in the R component is low and if the R content is low, a grain boundary phase-forming master alloy would not have a low melting point and closed voids would be unlikely to form. The grain boundary phase-forming master alloy used herein is free of boron (B). Boron in the grain boundary phase-forming master alloy does not contribute to an improvement in magnet properties and a lowering of the melting point thereof.

At least one of Al, Cu, Ga, Ni, Sn, Cr, V, Ti, and Mo may be added to the grain boundary phase-forming master alloy in addition to R, Fe, and Co. It is noted that the total content of these elements in the grain boundary phase-forming master alloy should preferably be up to 20% by weight because these elements form non-magnetic compounds to detract from remanence. Al and Cu is effective for improving both coercivity and corrosion resistance.

Although the technique of preparing the grain boundary phase-forming master alloy is not critical, a liquid quenching technique is preferably used as previously mentioned.

Since the grain boundary phase-forming master alloy, when melted by heat treatment, is fully wettable to particles of the primary phase-forming master alloy and quickly encloses the particles, the grain boundary phase-forming master alloy prior to melting is not particularly limited in shape and size. It is understood that when the grain boundary phase-forming master alloy is pulverized into a fine powder, oxidation inevitably occurs and oxides formed during pulverization are left in a magnet to detract from magnet properties. Then the mean particle size should preferably be more than 50 $\mu$m. On the other hand, if the grain boundary phase-forming master alloy is in a large bulk form, it must migrate or diffuse over a substantial distance before it can enclose the primary phase-forming master alloy particles. Then the maximum diameter should preferably be less than 10 mm.

Mixing and heat treatment

It is not critical how to produce a mixture of a primary phase-forming master alloy powder and a grain boundary phase-forming master alloy. Usually, they are mixed by means of a V mixer or the like. It is acceptable to simply rest a fine powder, crushed powder or fractured pieces of the grain boundary phase-forming master alloy on a powder of the primary phase-forming master alloy.

The proportion of the grain boundary phase-forming master alloy in the mixture is preferably 2 to 15% by weight, more preferably 3 to 11% by weight. A too low proportion would be insufficient to achieve the benefits of the invention whereas a too high proportion would make it difficult to produce a magnet with high remanence.

The thus obtained mixture is heat treated. The heat treating conditions are not particularly limited. Acceptable is the temperature at which the powder of grain boundary phase-forming master alloy melts and the powder of primary phase-forming master alloy is not sintered or over-sintered. Over-sintering makes difficult or impossible disintegration after the heat treatment and thus makes it difficult to impart anisotropy during compacting in a magnetic field. Illustratively, the treating temperature is preferably 600° to 1,000° C., more preferably 650° to 950° C. Too high treating temperatures would give rise to a problem in sintering of the primary phase-forming master alloy powder. If the treating temperature is too low, on the other hand, the grain boundary phase-forming master alloy becomes less flowing during the treatment, resulting in insufficient dispersion of the R-rich phase in the primary phase-forming master alloy powder after the treatment. It is understood that the grain boundary phase-forming master alloy is substantially instantaneously melted at its melting point to cover the primary phase-forming master alloy particles although it is preferred to hold at a temperature above the melting point for at least 10 minutes, more preferably at least 30 minutes in order to achieve full diffusion of elements between the two master alloys.

The mixture is not molded under pressure prior to the heat treatment and not compressed during the heat treatment. A container for holding the mixture during the heat treatment may be constructed by materials which do not react with the mixture during the heat treatment, for example, high-melting metals such as stainless steel and molybdenum.

After cooling, particles of the primary phase-forming master alloy are bound together by the grain boundary phase-forming master alloy coagulated therebetween. The mass is disintegrated into a magnet powder to be compacted.

It is noted that the powder of primary phase-forming master alloy is preferably magnetized prior to the heat treatment. In the primary phase-forming master alloy powder, those fine particles smaller than the mean particle size are difficult to separate by the disintegration process after the heat treatment and thus remain bound to large size particles through an R-rich phase even after the disintegration process, apparently forming a polycrystalline material. Since easy axes of magnetization of particles are not aligned in the thus formed polycrystalline material, compacting in a magnetic field will result in an insufficient degree of orientation. However, if the powder of primary phase-forming master alloy is magnetized prior to the dispersion and coagulation of the grain boundary phase-forming master alloy in the primary phase-forming master alloy powder, small size particles are incorporated into the polycrystalline material during heat treatment with their easy axis of magnetization aligned with large size particles. For this and other reasons, the primary phase-forming master alloy powder is magnetized while its temperature is below the Curie temperature. Preferably the primary phase-forming master alloy powder is magnetized in a magnetic field having a strength of at least 5 kOe.

Compacting step

In the compacting step, the magnet powder is compacted in a magnetic field. The density of a compact is not critical although it is preferably at least 5.5 g/cm$^3$, more preferably at least 6.0 g/cm$^3$ in order to provide a low shrinkage factor during sintering. A compact with a lower density is less desirable in that sufficient magnet properties can be achieved concomitant with an increased shrinkage factor during sintering and that a low shrinkage factor during sintering can be achieved concomitant with insufficient magnet properties. Although no particular upper limit is imposed on the density of a compact, it is difficult to achieve a density in excess of 6.4 g/cm$^3$. For example, a ultra-high pressure of higher than 20 t/cm$^2$ is necessary during compacting, and therefore, an expensive molding machine and mold must be used and a compact is limited to a simple shape. Although the use of a large amount of organic lubricant is effective for increasing the density of a compact, it is difficult to completely remove the organic lubricant before sintering, with the residual carbon in the magnet detracting from magnet properties. It is noted that the density of a compact can be calculated by the aforementioned procedure.

Since the compact having such a high density has a deflective strength of at least 0.3 kgf/mm$^2$, especially at least 0.5 kgf/mm$^2$, it is easy to handle and less liable to cracking and chipping.

The compacting pressure and the magnetic field applied during compacting are the same as in the first method.

Sintering step

The thus obtained contact is sintered into a magnet.

Preferably, sintering is effected so that the density of a sintered body minus the density of a compact (a density change during sintering) may be at least 0.2 g/cm$^3$. A too small density change in the sintering step would indicate short sintering, resulting in insufficient magnet properties and mechanical strength. In order to achieve a low shrinkage factor, the aforementioned high density compact is used and a density change of up to 1.5 g/cm$^3$, especially up to 1.2 g/cm$^3$ is preferably induced.

Various conditions during sintering are not particularly limited and they may be properly selected so as to achieve a desired density change during sintering. The sintering temperature is at or above the melting temperature of the grain boundary phase-forming master alloy. Since sintering does not proceed so fast in the high density compact using relatively large size powder mentioned above, the shrinkage factor can be suppressed low even when the sintering temperature is higher than the prior art so-called semi-sintering processes. More illustratively, heat treatment is preferably effected at 900° to 1,100° C. for ½ to 10 hours for sintering, followed by quenching. The sintering atmosphere is preferably vacuum or an inert gas atmosphere of argon gas or the like. Sintering in vacuum or in an inert gas atmosphere of reduced pressure is more preferred because the fraction of open voids can be reduced as previously described. It is noted that only a portion of the sintering step may be done in vacuum or in a reduced pressure atmosphere.

Treatments after sintering are the same as in the first method.

Dimensional deviation

According to the present invention, there is obtained a sintered magnet having a minimal dimensional deviation, which can be marketed without shape tailoring as by machining after sintering.

More particularly, according to the present invention, in a thin wall sintered magnet which has a parallel portion wherein the maximum length divided by the average thickness of the parallel portion is at least 10, the thickness deviation of the parallel portion can be declined to 1.5% or less and even easily to 1% or less. Even in a thin wall magnet having a maximum length/average thickness ratio of at least 15, the thickness deviation can be controlled to fall in this range. The parallel portion is a block interposed between two parallel opposed surfaces, and the magnet having a parallel portion is, for example, a plate-shaped, disk-shaped or ring-shaped magnets. The thickness deviation of the parallel portion is the difference between the maximum and the minimum of thickness of the parallel portion divided by the maximum length of the parallel portion. The thickness deviation of a parallel portion is an index indicating the deflection or non-uniform thickness of the parallel portion. Since thin wall sintered magnets having a dimensional ratio as mentioned above can have a substantial deflection or non-uniform thickness, conventional magnets generally have a thickness deviation of more than 2.5%.

Also according to the present invention, in a thin wall sintered magnet which has a cylindrical portion wherein the average outer diameter divided by the average wall thickness of the cylindrical portion is at least 10, the outer and/or inner diameter deviation of the cylindrical portion can also be declined to 1.5% or less and even easily to 1% or less. Even in a thin wall magnet having an average outer diameter/average wall thickness ratio of at least 15, the outer and/or inner diameter deviation can be controlled to fall in this range. The cylindrical portion is a cylindrical block having an outer circumferential surface or both outer and inner circumferential surfaces, and the magnet having a cylindrical portion is, for example, a ring-shaped or disk-shaped magnet. The outer or inner diameter deviation is correlated to a cylindrical portion having outer and inner circumferential surfaces. The outer diameter deviation of a cylindrical portion is the difference between the maximum and the minimum of outer diameter of the cylindrical portion divided by the average outer diameter of the cylindrical portion. The inner diameter deviation of a cylindrical portion is the difference between the maximum and the minimum of inner diameter of the cylindrical portion divided by the average inner diameter of the cylindrical portion. The outer or inner diameter deviation of a cylindrical portion is an index indicating the deflection, distortion or non-uniform thickness of the cylindrical portion. Since thin wall sintered magnets having a dimensional ratio as mentioned above can have a substantial deflection, distortion or non-uniform thickness, conventional magnets generally have an outer or inner diameter deviation of more than 3%.

It is understood that in a thin wall sintered magnet, typically disk-shaped magnet, including a cylindrical portion having only an outer circumferential surface wherein the average outer diameter/average thickness ratio is at least 10, especially at least 15, the outer diameter deviation of the cylindrical portion can also be declined to 1.5% or less and even easily to 1% or less.

In this specification, the thickness deviation of a parallel portion is determined as follows. First, an object to be measured is rested on a table such that one surface constituting the parallel portion is in close contact with the table. The height of the other surface constituting the parallel portion from the table surface is measured at 20 points. Next the object to be measured is reversed and rested on the table such that the other surface is in close contact with the table surface, and the height is similarly measured at 20 points. The measurement points are approximately center points of 20 substantially equal regions into which the surface of the object to be measured is divided. From all the measurements, the difference (Tmax−Tmin) between the maximum (Tmax) and the minimum (Tmin) is determined. The thickness deviation is given as the difference divided by the maximum L among the lengths of surfaces constituting the parallel portion (longitudinal lengths), that is, (Tmax−Tmin)/L. The thickness deviation of a thin wall magnet having at least two sets of parallel surfaces has a large value when the major surfaces are said one surface and said other surface. The average thickness described in conjunction with a thin wall magnet is an average of all measurements obtained as above.

The outer or inner diameter deviation of a cylindrical portion is determined as follows. First, the outer or inner diameter of a cylindrical portion is continuously measured in an axial direction thereof, obtaining the maximum and the minimum. At this point, those measurements in regions of 0.1 mm from the axially opposed ends of the cylindrical portion are omitted. Next, the cylindrical portion is rotated 15° about its axis before similar measurement is done. In this way, measurement is repeated at intervals of 15° over a circumferential direction of 180°, 12 times in total. The maximum among twelve maximum values is $\phi$max and the minimum among twelve minimum values is $\phi$min, and ($\phi$max−$\phi$min) is determined. Next, an average of twelve maximum values and an average of twelve minimum values are averaged to give an average $\phi_0$, which is an average outer or inner diameter. Then the outer or inner diameter deviation is given as ($\phi$max−$\phi$min)/$\phi_0$. The average outer or inner diameter described in conjunction with a thin wall magnet is said $\phi_0$ and the average wall thickness is (average outer diameter—average inner diameter)/2.

It is to be noted that for measurement of a dimensional deviation, non-contact type meters such as optical system meters or contact type meters such as contact type three-dimensional meters, micrometers, and inside micrometers may be used.

EXAMPLE

Specific examples of the present invention are given below by way of illustration.

Example 1-1 (first method)

Sintered magnet samples as shown in Table 1 were manufactured by the following method.

First ingots of primary phase-forming master alloy were prepared by casting. The composition of ingots is shown in Table 1. Note that the balance of the composition is iron (Fe). These alloy ingots had a mean crystal grain size of 300 $\mu$m. Each alloy ingot was crushed by utilizing volume expansion and contraction by hydrogen occlusion and degassing reaction and then milled by a disk mill into a powder having a mean particle size as shown in Table 1. The mean particle size of a powder was determined according to the aforementioned procedure from a photograph of a powder coating taken through an optical microscope.

Next, alloy melts were quenched by a single roll technique in an Ar atmosphere, obtaining grain boundary phase-forming master alloys of the composition shown in Table 1. Note that the balance of the composition shown in Table 1 is iron (Fe). The chill roll used was a copper roll. The grain boundary phase-forming master alloys were in the form of ribbons of 0.15 mm thick and confirmed to be amorphous by X-ray diffractometry. Each grain boundary phase-forming master alloy was milled in a pin mill and the resulting alloy powder was classified through a screen. The screens used for the classification of respective powders are shown in Table 1. In Table 1, a screen having a small opening for restricting the lower limit of particle size is designated a residual screen and a screen having a large opening for restricting the upper limit of particle size is designated a passing screen.

Next, the primary phase-forming master alloy powder was mixed with the grain boundary phase-forming master alloy powder. The amount of the grain boundary phase-forming master alloy powder added (or the proportion of the grain boundary phase-forming master alloy powder in the mixture) is shown in Table 1.

The mixtures were compacted in a magnetic field into disk-shaped compacts having a diameter of 20 mm and a thickness of 1.5 mm. The magnetic field had a strength of 12 kOe and was applied such that the easy axis of magnetization was aligned with the thickness direction of the compact. The compacting pressure and compact density are reported in Table 1.

Next, the compacts were sintered in vacuum and then quenched. The heat treating temperature and holding time of the sintering step are shown in Table 1. After sintering, the compacts were aged in an Ar atmosphere at 650° C. for one hour, obtaining disk-shaped sintered magnet samples. The density, density change during sintering, remanence or residual magnetic flux density (Br), and coercivity (Hcj) of each sintered magnet sample are shown in Table 1. For measurement of Br and Hcj, a magnetic property measuring sample prepared by sintering a compact of 15 mm diameter and 10 mm thick was used. Except for the compact dimensions, the conditions under which the magnetic property measuring sample was prepared were the same as the corresponding sample in Table 1. Each sample was determined for the total volume fractions of open voids and closed voids by the aforementioned procedure. Calculation was made based on a theoretical density of 7.55 g/cm$^3$ for magnets. The results are shown in Table 1.

TABLE 1

(first method)

| Sample No. | Primary phase-forming master alloy: Composition (wt %) R | B | Mean particle size (μm) | Grain boundary phase-forming master alloy: Composition (wt %) | Passing screen (μm) | Residual screen (μm) | Addition amount (wt %) |
|---|---|---|---|---|---|---|---|
| 101·X· | 28.2Nd | 1.11 | 55 | 88Nd | 75 | —** | 10 |
| 102·X· | 28.3Nd | 1.13 | 150 | 100Nd** | 250 | 53 | 7 |
| 103·X· | 30.0Nd | 1.09 | 6* | 89Nd | 425 | 53 | 5 |
| 104·X· | 32.0Nd | 1.09 | 125 | 91Nd | 250 | 38 | 8 |
| 105 | 29.0Nd | 1.10 | 93 | 87Nd + 8Co + 5Cu | 180 | 38 | 7 |
| 106 | 28.5Nd | 1.11 | 180 | 82Nd | 250 | 38 | 10 |
| 107 | 29.5Nd | 1.08 | 30 | 89Nd + 11Co | 425 | 38 | 7 |
| 108 | 29.0Nd | 1.13 | 90 | 86Nd + 0.5Al + 3Cu | 180 | 53 | 4 |
| 109 | 32.0Nd | 1.10 | 150 | 75Nd | 250 | 53 | 14 |
| 110 | 27.0Nd + 1.8Dy | 1.05 | 220 | 89Nd | 355 | 53 | 2.5 |
| 111 | 32.4Nd | 1.10 | 100 | 89Nd | 355 | 63 | 8 |
| 112 | 32.4Nd | 1.10 | 100 | 89Nd | 355 | 63 | 8 |
| 113 | 32.4Nd | 1.10 | 100 | 89Nd | 355 | 63 | 8 |
| 114 | 28.7Nd | 1.13 | 200 | 80Nd + 10Dy | 425 | 90 | 6 |
| 115 | 30.0Nd | 1.08 | 40 | 95Nd | 500 | 106 | 6 |

| Sample No. | Compacting pressure (t/cm²) | Density (g/cm³): Compact | Change | Magnet | Heat treating conditions: Temp. (°C.) | Time (hr) | Closed voids (vol %) | Open voids (vol %) | Br (kG) | Hcj (kOe) |
|---|---|---|---|---|---|---|---|---|---|---|
| 101·X· | 10 | 5.78 | 1.73 | 7.51* | 1075 | 5 | 0.8** | 0.0 | 11.0 | 18 |
| 102·X· | 10 | 5.93 | 0.50 | 6.45 | 1050 | 2.5 | 1.0** | 13.5* | 8.0 | 3 |
| 103·X· | 10 | 4.45* | 3.01 | 7.46* | 1050 | 3 | 0.5** | 0.5 | 11.3 | 17 |
| 104·X· | 10 | 5.94 | 0.15* | 6.09 | 875 | 2 | 1.2** | 17.8 | 7.1 | 1 |
| 105 | 10 | 5.83 | 0.92 | 6.75 | 1050 | 3 | 8.5 | 1.7 | 9.2 | 15 |
| 106 | 10 | 6.05 | 0.82 | 6.87 | 1025 | 2 | 8.0 | 1.0 | 9.0 | 15 |
| 107 | 10 | 5.73 | 1.06 | 6.99 | 1050 | 4 | 7.0 | 0.3 | 9.1 | 11 |
| 108 | 10 | 5.78 | 0.90 | 6.68 | 1050 | 4 | 10.2 | 1.5 | 8.6 | 17 |
| 109 | 10 | 6.03 | 1.05 | 7.08 | 1050 | 7 | 5.7 | 0.5 | 9.1 | 12 |
| 110 | 10 | 6.12 | 0.64 | 6.76 | 975 | 6 | 9.5 | 0.4 | 9.4 | 12 |
| 111 | 5* | 5.20* | 1.75 | 6.95 | 1040 | 4 | 5.0 | 2.9* | 8.8 | 16 |
| 112 | 13 | 6.06 | 0.95 | 7.01 | 1040 | 4 | 6.5 | 0.5 | 9.0 | 14 |
| 113 | 10 | 5.91 | 1.05 | 6.96 | 1040 | 4 | 6.8 | 0.9 | 8.9 | 15 |
| 114 | 10 | 6.15 | 0.67 | 6.82 | 1075 | 4 | 9.1 | 0.6 | 9.3 | 21 |
| 115 | 10 | 5.85 | 0.65 | 6.50 | 1100 | 4 | 12.5 | 1.3 | 8.7 | 14 |

·X·comparison
**) outside the scope of the invention
*) outside the preferred range Next, the thickness deviation of the respective samples was determined by the aforementioned procedure using a table of JIS 1 grade. As a result, the inventive samples had a very small thickness deviation of 0.2 to 0.8%, indicating that the deflection due to uneven shrinkage during sintering was minimal. Exception is sample No. 111 having a thickness deviation of 1.5% wherein sintering proceeded since the compact had a low density. If thin wall magnets of 1.5 mm thick have such a small thickness deviation, they are ready as commercial products without a need for dimensional correction by machining. Additionally, the inventive samples have satisfactory magnet properties as shown in Table 1. For the calculation of a thickness deviation, the diameter of a magnet was used as the maximum length of a parallel portion.

In contrast, in comparative sample No. 101, since the residual screen was not used and the lower limit of particle size of the grain boundary phase-forming master alloy powder was not restricted, over-sintering occurred due to the fine R-rich powder and hence, less closed voids were left. In comparative sample No. 103, since a low density compact formed using a primary phase-forming master alloy powder having a small particle size was sintered, over-sintering occurred and hence, less closed voids were left. Comparative sample Nos. 101 and 103 had a large thickness deviation of 2.9 to 6.3%, indicating that a substantial deflection occurred due to uneven shrinkage during sintering. Magnets having such a large thickness deviation cannot be tailored into commercial products.

Comparative sample No. 102 had a small thickness deviation of 0.8% because the compact had a high density and experienced a small density change during sintering. However, since Nd which is a high melting point metal was used as the grain boundary phase-forming master alloy, insufficient melting and flow occurred during sintering. As a result, this sample had a low closed void fraction, a high open void fraction, and an extremely low coercivity. Comparative sample No. 104 had a low closed void fraction, a high open void fraction, and an extremely low coercivity because of low-temperature sintering giving rise to a very small density change during sintering.

Figure 1B:
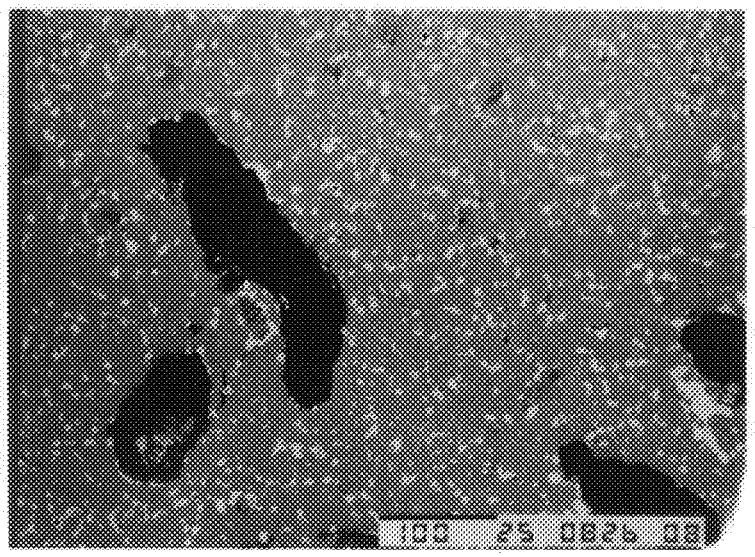

Next the average projection cross-sectional area of a closed void was determined by cutting each sample, polishing the section, forming a sputtered film of gold on the section, and taking a photograph thereof through a scanning electron microscope. FIGS. 1(*a*) and 1(*b*) are photographs with different magnifying powers of a section of sample No. 106. Observed in the figures are closed voids which were created as a result of melting and flowing of flaky grain boundary phase-forming master alloy powder. For each sample, 100 closed voids were measured. As a result, the inventive samples had an average projection cross-sectional area per closed void of 1,500 to 25,000 $\mu m^2$ whereas comparative sample Nos. 102 and 104 had an area of 100 to 700 $\mu m^2$, sample No. 101 had an area of 80 $\mu m^2$, and sample No. 103 had only an area of 5 $\mu m^2$.

Note that compacts having a density of at least 5.5 g/cm$^3$ exhibited a sufficiently high deflective strength of at least 0.45 kgf/mm$^2$. In contrast, the compact (density 4.45 g/cm$^3$) from which sample No. 103 was prepared had a low deflective strength of 0.15 kgf/mm$^2$.

Example 1-2 (first method)

Sintered magnet sample Nos. 103-2 and 108-2 were prepared by the same procedure as sample Nos. 103 and 108 of Example 1, respectively, except that they were of ring shape. The compact density was 4.43 g/cm$^3$ for sample No. 103-2 and 5.76 g/cm$^3$ for sample No. 108-2, which were slightly lower than those of sample Nos. 103 and 108 while the density change during sintering was the same as in sample Nos. 103 and 108. The compacts were dimensioned to have an outer diameter of 30 mm, an inner diameter of 27 mm, a wall thickness of 1.5 mm, and a height of 7 mm. During compacting, a magnetic field was applied such that the easy axis of magnetization was radially aligned.

These ring-shaped sintered magnet samples were measured for outer and inner diameter deviations by the aforementioned procedure. On measurement, each sample was rested on a table of JIS 1 grade such that the outer circumferential surface was in contact with the table surface. The outer diameter deviation was measured by means of a contact type three-dimensional meter and the inner diameter deviation was measured by means of an inside micrometer. As a result, inventive sample No. 108-2 had an outer diameter deviation of 0.30% and an inner diameter deviation of 0.32% which were very low enough, whereas sample No. 103-2 using a low density compact yielded an outer diameter deviation of 4.5% and an inner diameter deviation of 5.5% and could not be tailored into a commercial product.

Example 2-1 (second method)

Sintered magnet samples as shown in Table 2 were manufactured.

First alloy ingots of the composition shown in Table 2 were prepared by casting. Note that the balance of the composition is iron (Fe). These alloy ingots had a mean crystal grain size of about 400 $\mu$m. Each alloy ingot was crushed by utilizing volume expansion and contraction by hydrogen occlusion and degassing reaction and then milled by a disk mill into a magnet powder having a mean particle size as shown in Table 2. The mean particle size of a magnet powder was determined according to the aforementioned procedure from a photograph of a magnet powder coating taken through an optical microscope.

Next, the magnet powders were compacted in a magnetic field into disk-shaped compacts having a diameter of 20 mm and a thickness of 1.5 mm. The magnetic field had a strength of 12 kOe and was applied such that the easy axis of magnetization was aligned with the thickness direction of the compact. The compacting pressure and compact density are reported in Table 2.

The compacts were sintered in vacuum and then quenched. The heat treating temperature and holding time of the sintering step are shown in Table 2.

The density, density change during sintering, remanence (Br), and coercivity (Hcj) of each sintered magnet sample are shown in Table 2. For measurement of Br and Hcj, a magnetic property measuring sample prepared by sintering a compact of 15 mm diameter and 10 mm thick was used. Except for the compact dimensions, the conditions under which the magnetic property measuring sample was prepared were the same as the corresponding sample in Table 2.

TABLE 2

(second method)

| Sample No. | Composition (wt %) R | Composition (wt %) B | Mean particle size ($\mu$m) | Compacting pressure (t/cm$^2$) | Heat treating conditions Temp. (°C.) | Heat treating conditions Time (hr) | Density (g/cm$^3$) Compact | Density (g/cm$^3$) Change | Density (g/cm$^3$) Magnet | Br (kG) | Hcj (kOe) |
|---|---|---|---|---|---|---|---|---|---|---|---|
| 201 | 31.2Nd | 1.05 | 75 | 12 | 1000 | 5 | 5.84 | 1.05 | 6.89 | 9.4 | 5.4 |
| 202 | 32.5Nd | 1.08 | 130 | 10 | 1000 | 3 | 5.85 | 0.93 | 6.78 | 9.3 | 5.2 |
| 203 | 32.5Nd | 1.08 | 180 | 12 | 1025 | 3 | 6.02 | 0.87 | 6.89 | 9.2 | 5.5 |
| 204 | 34.0Nd | 1.10 | 250 | 10 | 1050 | 4 | 6.21 | 0.79 | 7.00 | 9.4 | 6.2 |
| 205 (comparison) | 32.9Nd | 1.15 | 40* | 6 | 1025 | 4 | 5.35* | 1.78 | 7.13 | 9.3 | 7.5 |
| 206 (comparison) | 33.2Nd | 1.09 | 140 | 4 | 1025 | 3 | 5.15* | 1.51 | 6.66 | 9.5 | 3.5 |
| 207 | 33.5Nd | 1.02 | 320 | 8 | 1075 | 3 | 6.24 | 0.65 | 6.89 | 9.0 | 4.9 |
| 208 | 30.0Nd + 2.5Dy | 1.11 | 125 | 12 | 1075 | 2 | 5.90 | 0.82 | 6.72 | 9.6 | 8.5 |
| 209 (comparison) | 30.0Nd + 2.5Dy | 1.11 | 5.2* | 3 | 1050 | 4 | 4.5* | 3.03 | 7.53 | 11.7 | 14.5 |
| 210 (comparison) | 31.8Nd | 1.16 | 160 | 10 | 880 | 5 | 6.02 | 0.02* | 6.04 | 7.8 | 1.5 |

*outside the scope of the invention

Next, the thickness deviation of the respective samples was determined by the aforementioned procedure using a table of JIS 1 grade. As a result, the inventive samples wherein compacts having a density of at least 5.5 g/cm$^3$ were sintered to a density of up to 7.15 g/cm$^3$ had a very small thickness deviation of 0.38% at maximum, indicating that the deflection due to uneven shrinkage during sintering was minimal. Note that the maximum length of a parallel portion used herein was the diameter of a sample. If thin wall magnets of 1.5 mm thick have such a small thickness deviation, they are ready as commercial products without a need for dimensional correction by machining. Additionally, the inventive samples have satisfactory magnet properties as shown in Table 2.

In contrast, comparative sample No. 205 had a density change in excess of 1.5 g/cm$^3$ due to over-sintering since the magnet powder had a mean particle size as small as 40 $\mu$m. Although a magnet powder having a large mean particle size was used, comparative sample No. 206 had insufficient magnetic properties and a large density change because the compact had a density of less than 5.5 g/cm$^3$. Comparative sample No. 209 had high magnetic properties, but a very large density change because a compact of a moderate density prepared using a magnet powder of small size particles was fully sintered. These comparative samples had a large thickness deviation of 2.6% at minimum, indicating that a substantial deflection occurred due to uneven shrinkage during sintering. Magnets having such a large thickness deviation cannot be tailored into commercial products. Comparative sample No. 210 had a density change as small as 0.02 g/cm$^3$ because of short sintering and did not exhibit satisfactory magnetic properties.

Note that compacts having a density of at least 5.5 g/cm$^3$ exhibited a sufficiently high deflective strength of at least 0.45 kgf/mm$^2$. In contrast, the compact (density 4.5 g/cm$^3$) from which sample No. 209 was prepared had a low deflective strength of 0.15 kgf/mm$^2$.

As is evident from these results, it is critical that a magnet powder having a mean particle size of at least 70 $\mu$m is used and a compact has a density of at least 5.5 g/cm$^3$.

Example 2-2 (second method)

Sintered magnet sample Nos. 207-2 and 209-2 were prepared by the same procedure as sample Nos. 207 and 209 of Example 2-1, respectively, except that they were of ring shape. The compact density was 6.22 g/cm$^3$ for sample No. 207-2 and 4.48 g/cm$^3$ for sample No. 209-2, which were slightly lower than those of sample Nos. 207 and 209 while the density change during sintering was the same as in sample Nos. 207 and 209. The compacts were dimensioned to have an outer diameter of 30 mm, an inner diameter of 27 mm, a wall thickness of 1.5 mm, and a height of 7 mm. During compacting, a magnetic field was applied such that the easy axis of magnetization was radially aligned.

These ring-shaped sintered magnet samples were measured for outer and inner diameter deviations by the aforementioned procedure. On measurement, each sample was rested on a table of JIS 1 grade such that the outer circumferential surface was in contact with the table surface. The outer diameter deviation was measured by means of a contact type three-dimensional meter and the inner diameter deviation was measured by means of an inside micrometer. As a result, inventive sample No. 207-2 had an outer diameter deviation of 0.2% and an inner diameter deviation of 0.35% which were very low enough, whereas sample No. 209-2 using a low density compact yielded an outer diameter deviation of 4.2% and an inner diameter deviation of 5% and could not be tailored into a commercial product.

Example 2-3 (second method)

Figure 2:
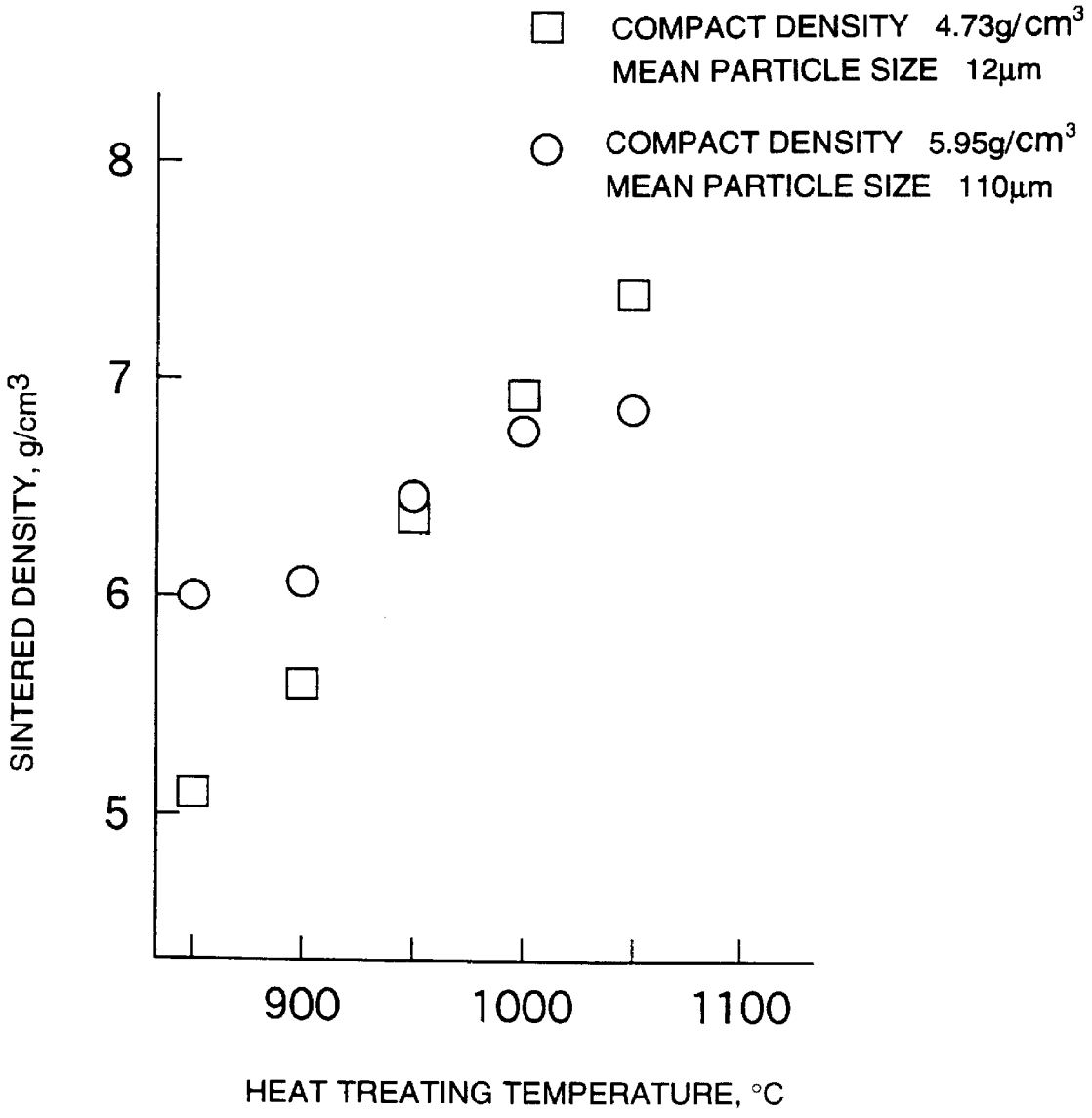
FIG. 2 is a graph showing the relationship of a sintered density to a heat treating temperature in a sintering step.

Using a compact with density 5.95 g/cm$^3$ prepared from a magnet powder having a mean particle size of 110 $\mu$m and a compact with density 4.73 g/cm$^3$ prepared from a magnet powder having a mean particle size of 12 $\mu$m, the relationship of a sintered density to a heat treating temperature of a sintering step was examined. The results are shown in FIG. 2. The holding time at the heat treating temperature shown in FIG. 2 was 2.5 hours.

It is evident from FIG. 2 that in low density compacts using a small size magnet powder, the sintered density largely varies in response to a change of heat treating temperature. In contrast, in high density compacts using a large size magnet powder, the sintered density varies only slightly in response to a change of heat treating temperature. Since sintering reaction proceeds little at 1,000° C. or higher, a strict temperature control is unnecessary.

Note that all sintered magnets prepared by the second method contained 2 to 15% by volume of closed voids and the fraction of open voids was less than 2% by volume.

Example 3-1 (third method)

Sintered magnet samples as shown in Table 3 were manufactured by the following method.

First ingots of primary phase-forming master alloy were prepared by casting. The composition of ingots is shown in Table 3. Note that the balance of the composition is iron (Fe). These alloy ingots had a mean crystal grain size of 300 $\mu$m. Each alloy ingot was crushed by utilizing volume expansion and contraction by hydrogen occlusion and degassing reaction and then milled by a disk mill into a powder having a mean particle size as shown in Table 3. The mean particle size of a powder was determined according to the aforementioned procedure from a photograph of a powder coating taken through an optical microscope.

Next, alloy melts were quenched by a single roll technique in an Ar atmosphere, obtaining grain boundary phase-forming master alloys of the composition shown in Table 3. Note that the balance of the composition shown in Table 3 is iron (Fe). The chill roll used was a copper roll. The grain boundary phase-forming master alloys were in the form of ribbons of 0.15 mm thick and confirmed to be amorphous by X-ray diffractometry. Each grain boundary phase-forming master alloy was milled in a pin mill and the resulting alloy powder was classified through a screen. The screens used for the classification of respective powders are shown in Table 3. In Table 3, a screen having a small opening for restricting the lower limit of particle size is designated a residual screen. A passing screen which is a screen having a large opening for restricting the upper limit of particle size was a screen having an opening of 425 $\mu$m.

R oxide powders were furnished as shown in Table 3. Each powder had a mean particle size of 3 to 8 $\mu$m.

These powders were mixed as shown in Table 3. In Table 3, the amount of the grain boundary phase-forming master alloy powder added is a proportion in the mixture. The content of R oxide was determined by measuring the quantity of oxygen after sintering by gas analysis and calculating the content of $Nd_2O_3$ provided that all the oxygen was contained as $Nd_2O_3$.

The mixtures were compacted in a magnetic field into disk-shaped compacts having a diameter of 20 mm and a thickness of 1.5 mm. The magnetic field had a strength of 12 kOe and was applied such that the easy axis of magnetization was aligned with the thickness direction of the compact. The compacting pressure and compact density are reported in Table 3.

Next, the compacts were sintered in vacuum and then quenched. The heat treating temperature and holding time of the sintering step are shown in Table 3. After sintering, the compacts were aged in an Ar atmosphere at 650° C. for one hour, obtaining disk-shaped sintered magnet samples. The density, density change during sintering, remanence (Br), and coercivity (Hcj) of each sintered magnet sample are shown in Table 3. For measurement of Br and Hcj, a magnetic property measuring sample prepared by sintering a compact of 15 mm diameter and 10 mm thick was used. Except for the compact dimensions, the conditions under which the magnetic property measuring sample was prepared were the same as the corresponding sample in Table 3. Each sample was determined for the total volume fractions of open voids and closed voids by the aforementioned procedure. Calculation was made based on a theoretical density of 7.55 g/cm$^3$ for magnets. The results are shown in Table 3.

a very small thickness deviation of 0.2 to 0.8%, indicating that the deflection due to uneven shrinkage during sintering was minimal. If thin wall magnets of 1.5 mm thick have such a small thickness deviation, they are ready as commercial products without a need for dimensional correction by machining. Additionally, the inventive samples have satisfactory magnet properties as shown in Table 3. In particular, sample Nos. 305, 306 and 307 using a two alloy route exhibited high coercivity. For the calculation of a thickness deviation, the diameter of a magnet was used as the maximum length of a parallel portion.

In contrast, sample No. 308 contained less closed voids due to over-sintering because the R oxide powder was omitted. Sample No. 309 contained less closed voids due to over-sintering because a low density compact formed from a primary phase-forming master alloy powder having a small particle size was sintered. Comparative sample Nos. 308 and 309 had a large thickness deviation of 2.9 to 6.3%, indicating that a substantial deflection occurred due to uneven shrinkage during sintering. Magnets having such a large thickness deviation cannot be tailored into commercial products.

Next the average projection cross-sectional area of a closed void was determined by cutting each sample, polishing the section, forming a sputtered film of gold on the section, and taking a photograph thereof through a scanning electron microscope. For each sample, 100 closed voids

TABLE 3

(third method)

| | Primary phase-forming master alloy | | | | | Grain boundary phase-forming master alloy | | |
|---|---|---|---|---|---|---|---|---|
| | Composition (wt %) | | Mean particle size | R oxide | | | Residual screen | Addition amount |
| Sample No. | R | B | (μm) | Particles added | Content (wt %) | Composition (wt %) | (μm) | (wt %) |
| 301 | 34.3Nd | 1.05 | 120 | $Nd_2O_3$ | 3.5 | — | — | — |
| 302 | 34.1Nd + 2.8Dy | 1.09 | 78 | $Nd_2O_3$ | 5 | — | — | — |
| 303 | 36.5Nd | 1.12 | 150 | $Nd_2O_3$<br>$Dy_2O_3$ | 3<br>2 | — | — | — |
| 304 | 33.8Nd | 1.15 | 240 | $Dy_2O_3$<br>$Nd_2O_3$ | 4<br>1 | — | — | — |
| 305 | 29.5Nd | 1.08 | 95 | $Nd_2O_3$ | 2.5 | 91Nd + 3Cu | 38 | 3 |
| 306 | 28.0Nd | 1.12 | 116 | $Nd_2O_3$ | 6 | 89Nd | 53 | 4 |
| 307 | 27.8Nd | 1.10 | 60 | $Pr_6O_{11}$ | 3 | 50Dy + 35Nd | 63 | 6 |
| 308※ | 28.8Nd | 1.12 | 70 | —** | —** | 92Nd + 7Co | 38 | 8 |
| 309※ | 32.5Nd | 1.11 | 3.8* | $Nd_2O_3$ | 4 | — | — | — |

| | Compacting pressure | Density (g/cm$^3$) | | | Heat treating conditions | | Closed voids | Open voids | Br | Hcj |
|---|---|---|---|---|---|---|---|---|---|---|
| Sample No. | (t/cm$^2$) | Compact | Change | Magnet | Temp. (°C.) | Time (hr) | (vol %) | (vol %) | (kG) | (kOe) |
| 301 | 10 | 5.98 | 0.89 | 6.87 | 1030 | 3 | 8.5 | 0.5 | 9.7 | 12 |
| 302 | 8 | 5.60 | 0.29 | 5.89 | 980 | 6 | 14 | 1.8 | 7.8 | 11 |
| 303 | 10 | 6.05 | 0.76 | 6.81 | 1050 | 2 | 7.8 | 1.9 | 8.8 | 15 |
| 304 | 12 | 6.17 | 0.54 | 6.71 | 1025 | 4 | 9.5 | 1.6 | 9.0 | 18 |
| 305 | 10 | 5.78 | 1.15 | 6.93 | 1060 | 6 | 7.5 | 0.7 | 9.5 | 20 |
| 306 | 10 | 6.03 | 0.25 | 6.28 | 1040 | 4 | 15 | 1.8 | 8.2 | 17 |
| 307 | 9 | 5.83 | 1.02 | 6.85 | 1050 | 3 | 7.5 | 1.5 | 9.5 | 19 |
| 308* | 9 | 5.81 | 1.55 | 7.36* | 1070 | 4 | <2** | 0.3 | 10.3 | 16 |
| 309* | 2 | 4.28* | 3.05 | 7.33* | 1070 | 3 | <2** | 0.9 | 11.2 | 13 |

※comparison
**outside the scope of the invention
*outside the preferred range

Next, the thickness deviation of the respective samples was determined by the aforementioned procedure using a table of JIS 1 grade. As a result, the inventive samples had were measured. As a result, the inventive samples had an average projection cross-sectional area per closed void of 1,500 to 25,000 $\mu m^2$ whereas comparative sample No. 308 had an area of 80 $\mu m^2$ and sample No. 309 had only an area of 5 $\mu m^2$. In the inventive samples using the two alloy route, closed voids which were created as a result of melting and flowing of flaky grain boundary phase-forming master alloy powder were observed.

Note that compacts having a density of at least 5.5 g/cm$^3$ exhibited a sufficiently high deflective strength of at least 0.45 kgf/mm$^2$. In contrast, the compact (density 4.28 g/cm$^3$) from which sample No. 309 was prepared had a low deflective strength of 0.15 kgf/mm$^2$.

Example 3-2 (third method)

Sintered magnet sample Nos. 305-2 and 309-2 were prepared by the same procedure as sample Nos. 305 and 309 of Example 3-1, respectively, except that they were of ring shape. The compact density was 5.75 g/cm$^3$ for sample No. 305-2 and 4.27 g/cm$^3$ for sample No. 309-2, which were slightly lower than those of sample Nos. 305 and 309 while the density change during sintering was the same as in sample Nos. 305 and 309. The compacts were dimensioned to have an outer diameter of 30 mm, an inner diameter of 27 mm, a wall thickness of 1.5 mm, and a height of 7 mm. During compacting, a magnetic field was applied such that the easy axis of magnetization was radially aligned.

These ring-shaped sintered magnet samples were measured for outer and inner diameter deviations by the aforementioned procedure. On measurement, each sample was rested on a table of JIS 1 grade such that the outer circumferential surface was in contact with the table surface. The outer diameter deviation was measured by means of a contact type three-dimensional meter and the inner diameter deviation was measured by means of an inside micrometer. As a result, inventive sample No. 305-2 had an outer diameter deviation of 0.30% and an inner diameter deviation of 0.32% which were very low enough, whereas sample No. 309-2 obtained by sintering a low density compact yielded an outer diameter deviation of 4.5% and an inner diameter deviation of 5.5% and could not be tailored into a commercial product.

Example 4 (fourth method)

Sintered magnets as shown in Table 4 were manufactured by the inventive method, two alloy method, and conventional sintering method (designated single alloy method in Table 4).

Inventive method

First ingots of primary phase-forming master alloy were prepared by casting. The composition of ingots is shown in Table 4. Note that the balance of the composition is iron (Fe). These alloy ingots had a mean crystal grain size of about 300 $\mu m$ and the average major axis/minor axis ratio of crystal grains was 2.5 or less in all the ingots. Each alloy ingot was crushed by utilizing volume expansion and contraction by hydrogen occlusion and degassing reaction and then milled by a disk mill into a powder having a mean particle size as shown in Table 4. The mean particle size of a powder was determined according to the aforementioned procedure from a photograph of a powder coating taken through an optical microscope. In all the powders, the average major axis/minor axis ratio of powder particles was 2.5 or less.

Next, alloy melts were quenched by a single roll technique in an Ar atmosphere, obtaining grain boundary phase-forming master alloys of the composition shown in Table 4. Note that the balance of the composition shown in Table 4 is iron (Fe). The chill roll used was a copper roll. The grain boundary phase-forming master alloys were in the form of ribbons of 0.15 mm thick and confirmed to be amorphous by X-ray diffractometry. Each grain boundary phase-forming master alloy was milled into a size of less than 2 mm square using a stamp mill.

Next, the primary phase-forming master alloy powder was mixed with the grain boundary phase-forming master alloy in a V mixer. A magnetic field of 10 kOe was applied across the mixture to magnetize the primary phase-forming master alloy powder. The amount of the grain boundary phase-forming master alloy added (or the proportion of the grain boundary phase-forming master alloy in the mixture) is shown in Table 4.

Each mixture was placed in a molybdenum boat and heat treated in vacuum at 800° C. for 30 minutes. The grain boundary phase-forming master alloys shown in Table 4 all melted before 800° C. was reached.

After the heat treatment, the primary phase-forming master alloy powder bound together by the grain boundary phase-forming master alloy serving as a binder was disintegrated into a powder of particles with a size of less than about 500 $\mu m$.

Each disintegrated powder was compacted in a magnetic field into a disk-shaped compact having a diameter of 20 mm and a thickness of 1.5 mm. The magnetic field had a strength of 8 kOe and was applied such that the easy axis of magnetization was aligned with the thickness direction of the compact. The compacting pressure and compact density are reported in Table 4.

Next, the compacts were sintered in vacuum and then quenched. The sintering temperature and holding time thereat are shown in Table 4. After sintering, the compacts were aged in an Ar atmosphere at 650° C. for one hour, obtaining disk-shaped sintered magnet samples. The density, density change during sintering, remanence (Br), and coercivity (Hcj) of each sintered magnet sample are shown in Table 4. For measurement of Br and Hcj, a magnetic property measuring sample prepared by sintering a compact of 15 mm diameter and 10 mm thick was used. Except for the compact dimensions, the conditions under which the magnetic property measuring sample was prepared were the same as the corresponding sample in Table 4. Each sample was determined for the total volume fractions of open voids and closed voids by the aforementioned procedure. Calculation was made based on a theoretical density of 7.55 g/cm$^3$ for magnets. The results are shown in Table 4.

Two alloy method

A grain boundary phase-forming master alloy was prepared by the same procedure as above and milled in a pin mill and the resulting alloy powder was classified through screens. A screen having an opening of at least 38.$\mu m$ was used as a screen having a small opening for restricting the lower limit of particle size (residual screen). A screen having an opening of up to 355 $\mu m$ was used as a screen having a large opening for restricting the upper limit of particle size (passing screen). The resulting samples were similarly measured. The results are shown in Table 4.

Single alloy method

A sintered magnet was manufactured from one type of master alloy without using a grain boundary phase-forming master alloy. The resulting sample was similarly measured. The results are shown in Table 4.

TABLE 4

(fourth method)

| Sample No. | Primary phase-forming master alloy: Composition (wt %) R | B | Mean particle size (μm) | Grain boundary phase-forming master alloy: Composition (wt %) | Addition amount (wt %) | Compacting pressure (t/cm²) |
|---|---|---|---|---|---|---|
| 401 | | | 0 | 84Nd + 10Co | 7 | 8 |
| 402 | 28.5Nd | 1.12 | 10* | 84Nd + 10Co | 6 | 8 |
| 403 (Single alloy method) | 31.7Nd | 1.12 | 4* | —** | —** | 8 |
| 404 | 29.8Nd | 1.10 | 180 | 88Nd | 7 | 10 |
| 405 (Two alloy method) | 28.5Nd | 1.11 | 180 | 82Nd | 10 | 10 |
| 406 | 29.5Nd | 1.13 | 90 | 89Nd | 5 | 10 |
| 407 (Two alloy method) | 28.5Nd | 1.11 | 180 | 89Nd | 8 | 10 |
| 408 | 28.6Nd + 1Dy | 1.10 | 110 | 82Nd + 10Co + 8Cu | 6 | 10 |
| 409 | 28.2Nd + 1Dy | 1.12 | 100 | 85Nd + 1.5Al +10Co | 6 | 8 |
| 410 (Two alloy method) | 29.2Nd | 1.13 | 90 | 86Nd + 3Cu + 11Co | 4 | 10 |

| Sample No. | Density (g/cm³) Compact | Change | Magnet | Sintering Temp. (°C.) | Time (hr) | Closed voids (vol %) | Open voids (vol %) | Br (kG) | Hcj (kOe) |
|---|---|---|---|---|---|---|---|---|---|
| 401 | 5.95 | 0.92 | 6.87 | 1050 | 4 | 8.1 | 0.7 | 9.4 | 20 |
| 402 | 5.50 | 1.85* | 7.35* | 1050 | 3 | 2.0 | 0.5 | 11.8 | 21 |
| 403 (Single alloy method) | 5.42* | 2.05* | 7.47* | 1050 | 3 | 0.2* | 0.5 | 12.3 | 15 |
| 404 | 6.10 | 0.77 | 6.87 | 1025 | 2 | 8.0 | 1.1 | 9.4 | 19 |
| 405 (Two alloy method) | 6.05 | 0.82 | 6.87 | 1025 | 2 | 8.0 | 1.0 | 9.0 | 15 |
| 406 | 6.02 | 0.85 | 6.87 | 1025 | 5 | 8.0 | 0.8 | 9.2 | 18 |
| 407 (Two alloy method) | 6.05 | 0.85 | 6.90 | 1025 | 3 | 7.6 | 1.0 | 9.1 | 15 |
| 408 | 6.08 | 0.82 | 6.90 | 1075 | 2 | 7.5 | 0.8 | 9.3 | 20 |
| 409 | 5.90 | 1.12 | 7.02 | 1060 | 4 | 6.5 | 0.5 | 9.2 | 24 |
| 410 (Two alloy method) | 5.79 | 0.92 | 6.71 | 1050 | 4 | 9.8 | 1.5 | 8.7 | 17 |

**outside the scope of the invention
*outside the preferred range

Sample Nos. 401 to 403 had a substantially equal R content. Although sample Nos. 402 and 403 were obtained by compacting a primary phase-forming master alloy powder of a small size into a compact having a relatively low density and sintering it into a high density magnet, inventive sample No. 402 had a significantly higher coercivity than sample No. 403 relying on the single alloy method. Sample No. 401, in which a density increase upon sintering was suppressed by compacting a primary phase-forming master alloy powder of a large size into a compact having a relatively high density, also had a significantly higher coercivity than sample No. 403.

While sample Nos. 404 and 405 had a substantially equal R content, inventive sample No. 404 had a higher coercivity than sample No. 405 relying on the single alloy method. Additionally, in sample No. 404, the amount of the grain boundary phase-forming master alloy used was smaller and the remanence was higher.

The inventive samples except for sample No. 402 were low density magnets which were obtained by using a powder of a large mean particle size as the primary phase-forming master alloy powder, compacting it into a high density compact, and sintering. They contained much closed voids, indicating minimal shrinkage during sintering. These samples also had a small fraction of open voids and were thus fully resistant to corrosion. In contrast, the samples relying on the two alloy method had a lower coercivity than the inventive samples despite a small fraction of open voids.

Sample Nos. 408 and 409 exhibited high coercivity since a grain boundary phase-forming master alloy containing Al or Cu was used. Sample No. 410 relying on the two alloy method also exhibited relatively high coercivity since a grain boundary phase-forming master alloy contained Cu, but that coercivity was not only lower than those of sample Nos. 408 and 409, but also lower than that of sample No. 406 using a Cu-free grain boundary phase-forming master alloy.

Next, the thickness deviation of the respective samples was determined by the aforementioned procedure using a table of JIS 1 grade. As a result, the inventive samples except for sample No. 402 had a very small thickness deviation of less than 0.9%, indicating that the deflection due to uneven shrinkage during sintering was minimal. If thin wall magnets of 1.5 mm thick have such a small thickness deviation, they are ready as commercial products without a need for dimensional correction by machining. Additionally, the inventive samples have satisfactory magnet properties as shown in Table 4. For the calculation of a thickness deviation, the diameter of a magnet was used as the maximum length of a parallel portion.

In contrast, Sample No. 403 contained less closed voids due to over-sintering because a low density compact formed from a master alloy powder having a small particle size was sintered. It had a large thickness deviation of more than 3%, indicating that a substantial deflection occurred due to uneven shrinkage during sintering. Magnets having such a large thickness deviation cannot be tailored into commercial products.

Note that compacts having a density of at least 5.5 g/cm³ exhibited a sufficiently high deflective strength of at least 0.45 kgf/mm².

The benefits of the invention are evident from the results of the foregoing Examples.

We claim:

1. A sintered magnet comprising R, T and B wherein R is at least one element of rare earth elements inclusive of yttrium and T is iron or iron and cobalt, and containing 2 to 15% by volume of closed voids.

2. The sintered magnet of claim 1 which contains 3 to 15% by volume of closed voids.

3. The sintered magnet of claim 1 which has a density of up to 7.2 g/cm$^3$.

4. The sintered magnet of claim 1 wherein the closed voids each have an average projection cross-sectional area of 1,000 to 30,000 $\mu$m$^2$.

5. The sintered magnet of claim 1 wherein the fraction of open voids is up to 2% by volume.

6. The sintered magnet of claim 1 which consists essentially of 30 to 45% by weight of R, 0.5 to 3.5% by weight of B and the balance of T.

7. The sintered magnet of claim 1 which has not been shaped after sintering and which has a parallel portion, wherein the maximum length divided by the average thickness of said parallel portion is at least 10, and a thickness deviation is up to 1.5%, the thickness deviation being the difference between the maximum and the minimum of thickness of said parallel portion divided by the maximum length of said parallel portion.

8. The sintered magnet of claim 1 which has not been shaped after sintering and which has a cylindrical portion, wherein the average outer diameter divided by the average wall thickness of said cylindrical portion is at least 10, and an outer diameter deviation is up to 1.5%, the outer diameter deviation being the difference between the maximum and the minimum of outer diameter of said cylindrical portion divided by the average outer diameter of said cylindrical portion.

9. The sintered magnet of claim 1 which has not been shaped after sintering and which has a cylindrical portion, wherein the average outer diameter divided by the average wall thickness of said cylindrical portion is at least 10, and an inner diameter deviation is up to 1.5%, the inner diameter deviation being the difference between the maximum and the minimum of inner diameter of said cylindrical portion divided by the average inner diameter of said cylindrical portion.

10. The sintered magnet of claim 1 which contains 0.5 to 10% by weight of an R oxide.

11. The sintered magnet of claim 1, prepared by a process comprising the steps of compacting a mixture of a magnet powder having crystal grains consisting essentially of $R_2T_{14}B$ and an R oxide powder to form a compact having a density of at least 5.5 g/cm$^3$ and sintering the compact so as to induce a density change of at least 0.2 g/cm$^3$.

12. The sintered magnet of claim 11, wherein said magnet powder has a mean particle size of 30 to 350 ||m.

13. The sintered magnet of claim 1 prepared by a method comprising the steps of compacting a mixture of a powder of a primary phase-forming master alloy having crystal grains consisting essentially of $R_2T_{14}B$, a powder of a grain boundary phase-forming master alloy consisting essentially of 70 to 97% by weight of R and the balance of iron and/or cobalt, and a powder of an R oxide to form a compact and sintering the compact.

14. The sintered magnet of claim 13, wherein said primary phase-forming master alloy powder has a mean particle size of 30 to 350 $\mu$m.

15. The sintered magnet of claim 13, wherein said boundary phase-forming master alloy is left on a screen having an opening of at least 38 $\mu$m, but passes a screen having an opening of up to 500 $\mu$m.

16. The sintered magnet of claim 11, wherein said R oxide powder is present in said mixture in a proportion of 0.5 to 10% by weight and has a mean particle size of 0.5 to 20 $\mu$m.

17. The sintered magnet of claim 13, wherein said R oxide powder is present in said mixture in a proportion of 0.5 to 10% by weight and has a mean particle size of 0.5 to 20 $\mu$m.

18. A sintered magnet comprising R, T and B, wherein R is at least one element of the rare earth elements inclusive of yttrium, and T is iron or iron and cobalt, wherein said magnet is made by compacting a mixture of a powder of a primary phase-forming master alloy and a powder of a grain boundary phase-forming master alloy with a compacting pressure of at least 6 t/cm$^2$, and sintering the compact to form said magnet containing 2–15% by volume of closed voids, wherein grains of said primary phase-forming master alloy have a mean particle size of at least 20 microns, and grains of said grain boundary phase-forming master alloy have particles sizes from 38 to 500 microns.

* * * * *